US009944087B2

(12) United States Patent
Sato et al.

(10) Patent No.: US 9,944,087 B2
(45) Date of Patent: Apr. 17, 2018

(54) LIQUID EJECTING APPARATUS AND PRESSURE-REGULATING DEVICE

(71) Applicant: SEIKO EPSON CORPORATION, Tokyo (JP)

(72) Inventors: Masahiko Sato, Matsumoto (JP); Keiji Matsumoto, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/358,406

(22) Filed: Nov. 22, 2016

(65) Prior Publication Data

US 2017/0151805 A1 Jun. 1, 2017

(30) Foreign Application Priority Data

Dec. 1, 2015 (JP) ..... 2015-234476

(51) Int. Cl.
*B41J 2/165* (2006.01)
*B41J 2/175* (2006.01)

(52) U.S. Cl.
CPC ..... *B41J 2/17596* (2013.01); *B41J 2/16526* (2013.01); *B41J 2/175* (2013.01); *B41J 2/17509* (2013.01)

(58) Field of Classification Search
CPC .... B41J 2/16526; B41J 2/175; B41J 2/17509; B41J 2/17523; B41J 2/17556; B41J 2/17596; B41J 2/18
See application file for complete search history.

(56) References Cited

U.S. PATENT DOCUMENTS 5,719,609 A * 2/1998 Hauck ..... B41J 2/17513 137/907
6,663,233 B2 * 12/2003 Otsuka ..... B41J 2/17506 141/114
6,837,575 B2 * 1/2005 Usui ..... B41J 2/17596 347/85
7,422,317 B2 * 9/2008 Miyazawa ..... B41J 2/17503 347/84
8,721,060 B2 * 5/2014 Yokoyama ..... B41J 2/175 347/89
2003/0146958 A1 8/2003 Aruga et al.
2011/0193900 A1 8/2011 Aruga et al.
2012/0127242 A1 5/2012 Koike et al.

FOREIGN PATENT DOCUMENTS

JP 2004-142405 A 5/2004
JP 2009-178889 A 8/2009
JP 2011-450565 A 12/2011
(Continued)

*Primary Examiner* — Anh T. N. Vo
(74) *Attorney, Agent, or Firm* — Workman Nydegger

(57) ABSTRACT

A liquid ejecting apparatus includes a pressure-regulating mechanism which is provided in a liquid supply path in which it is possible to supply liquid to a liquid ejecting unit, and includes a liquid accommodation part which can accommodate the liquid internally, and in which a volume of the liquid accommodation part is changed depending on displacing of a diaphragm section, in which the diaphragm section includes an annular corrugated portion formed in a sectional waveform shape which is deformed when the diaphragm section receives pressure.

10 Claims, 20 Drawing Sheets

(56) References Cited

FOREIGN PATENT DOCUMENTS

| | | | |
|---|---|---|---|
| JP | 2012-111044 | A | 6/2012 |
| JP | 2013-091281 | A | 5/2013 |
| JP | 2014-188924 | A | 10/2014 |
| JP | 2015-030173 | A | 2/2015 |
| JP | 2015-074121 | A | 4/2015 |
| JP | 2015-075146 | A | 4/2015 |

* cited by examiner

LIQUID EJECTING APPARATUS AND PRESSURE-REGULATING DEVICE

BACKGROUND

1. Technical Field

The present invention relates to a liquid ejecting apparatus such as an ink jet printer and a pressure-regulating device which regulates the pressure of liquid in the liquid ejecting apparatus.

2. Related Art

In the related art, ink jet printers which perform printing by ejecting ink (liquid) supplied from an ink tank (liquid supply source) to a medium from an ink jet head (liquid ejecting unit) are known as an example of a liquid ejecting apparatus. There are printers provided with a damper (pressure-regulating device) which regulates the pressure of ink supplied to the ink jet head within such printers (JP-A-2009-178889).

The damper is provided with a pressure varying chamber (fluid chamber) which is partitioned by a flexible film (diaphragm section), and a head side liquid chamber (liquid accommodation unit). In addition, the damper is provided with a tank side liquid chamber (liquid inflow unit) which is connected to the head side liquid chamber using an ink path (communication path), and a valve (on-off valve) which opens or closes the ink path.

In addition, the flexible film is displaced according to pressure of the pressure varying chamber, transmits the pressure of the pressure varying chamber to the head side liquid chamber, and opens the valve in a case in which the pressure in the pressure varying chamber increases.

Meanwhile, the head side liquid chamber is formed when the flexible film is bonded thereto so as to cover an opening. For this reason, in order to cause the flexible film to be easily displaced, it is necessary to perform bonding in a state in which the flexible film is bent. However, when performing such bonding, creases occur in the flexible film.

When pressure of the pressure varying chamber is large, the flexible film is greatly displaced in a direction in which a volume of the head side liquid chamber is decreased. That is, for example, the flexible film is greatly displaced compared to a case of performing printing, in a case in which cleaning in which pressurized ink is supplied by forcibly opening the valve is performed. In addition, when the flexible film is greatly displaced, bending, or a state of creases of the flexible film is changed, and there is a case in which an on-off operation, or an opening pressure of the valve becomes unstable.

Such a problem is not limited to an ink jet printer, and is generally common in a liquid ejecting apparatus, and a pressure-regulating device which regulates pressure of liquid in the liquid ejecting apparatus.

SUMMARY

An advantage of some aspects of the invention is to provide a liquid ejecting apparatus and a pressure-regulating device which can stably open or close an on-off valve.

hereinafter, means of the invention and operation effects thereof will be described.

According to an aspect of the invention, there is provided a liquid ejecting apparatus including a pressure-regulating mechanism which is provided in a liquid supply path in which it is possible to supply liquid from a liquid supply source to a liquid ejecting unit which ejects the liquid from a nozzle, by driving an actuator, the pressure-regulating mechanism including a liquid inflow part into which the liquid supplied from the liquid supply source flows, a liquid accommodation part which can accommodate the liquid internally, and a volume of the liquid accommodation part is changed depending on displacing a diaphragm section, a communication path through which the liquid inflow part and the liquid accommodation part communicate, and an on-off valve which enters an open state in which the liquid inflow part and the liquid accommodation part communicate from a closed state in which the liquid inflow part and the liquid accommodation part on the communication path do not communicate, when a pressure applied to a first face which is an inner face of the liquid accommodation part of the diaphragm section is lower than a pressure applied to a second face which is an outer face of the liquid accommodation part of the diaphragm section, and a difference between the pressure applied to the first face and the pressure applied to the second face is a predetermined value or more; and a pressurizing mechanism which can pressurize the liquid which is supplied to the pressure-regulating mechanism, in which the diaphragm section is provided with a pressure receiving portion which receives a pressure at an on-off time of the on-off valve, and an annular corrugated portion which is formed in a sectional waveform shape which is provided between the pressure receiving portion and an outer edge portion of the diaphragm section and is deformed when the diaphragm section receives a pressure.

According to the configuration, in the diaphragm section, the annular corrugated portion is deformed according to a difference in pressure which is applied to the first face and the second face. That is, since it is possible to deform the diaphragm section without bending the diaphragm section at a time of bonding the diaphragm section, it is possible to reduce creases which occur in a case of bonding the diaphragm section. For this reason, for example, even in a case in which liquid pressurized by the pressurizing mechanism is supplied, and cleaning is performed, it is possible to stabilize deforming of the diaphragm section. Accordingly, it is possible to stably open or close the on-off valve which is opened or closed along with deforming of the diaphragm section.

In the liquid ejecting apparatus, it is preferable that at least the annular corrugated portion in the diaphragm section be configured of a single layer in which a material selected from a group including polyethylene, polypropylene, polyester, polyphenylene sulfide, polyimide, and polyamide is used as a main component.

For example, in a case in which the diaphragm section is configured by binding a plurality of films using an adhesive, it is necessary to form the annular corrugated portion by taking a difference in a melting point, a thickness, or the like of each film into consideration. According to the configuration, in this point, since the diaphragm section is configured of a single layer of a preferable material, it is possible to easily form the corrugated portion.

In the liquid ejecting apparatus, it is preferable that at least the annular corrugated portion in the diaphragm section include an inner layer in which a material selected from a group including polyethylene, polypropylene, polyester, polyphenylene sulfide, polyimide, and polyamide is used as a main component, and a gas barrier layer with high gas barrier properties compared to the inner layer, and that the gas barrier layer be provided on the second face side, rather than the inner layer.

According to the configuration, since the diaphragm section is configured of a plurality of layers including the gas barrier layer, it is possible to reduce a concern that air penetrating the diaphragm section may enter the liquid accommodation part.

It is preferable that the liquid ejecting apparatus further include a fluid chamber which is formed so as to cover the second face of the diaphragm section, and the fluid chamber include a fluid resistance unit which disturbs flowing out of fluid from the fluid chamber.

According to the configuration, it is possible to cause an evaporated solvent component to remain in the fluid chamber by providing the fluid chamber, even when the solvent component of liquid in the liquid accommodation part is evaporated through the diaphragm section. That is, it is possible to raise a humidity on the second face side of the diaphragm section, by providing the fluid chamber, compared to a case in which the fluid chamber is not provided, and the solvent component diffuses into the atmosphere. Accordingly, it is possible to suppress evaporation of the solvent component of liquid in the liquid accommodation part. Fluid in the fluid chamber flows out while receiving resistance using the fluid resistance unit. For this reason, even in a case in which the diaphragm section is displaced, it is possible to reduce a fluctuation of pressure in the fluid chamber, while suppressing a decrease in humidity in the fluid chamber.

It is preferable that the liquid ejecting apparatus further include a valve opening mechanism which sets the on-off valve to an open state, and that the liquid which is pressurized by the pressurizing mechanism be supplied to the liquid ejecting unit, in the open state of the on-off valve using the valve opening mechanism.

According to the configuration, since the valve opening mechanism can forcibly set the on-off valve to an open state, it is possible to preferably perform cleaning of the liquid ejecting unit, by supplying liquid which is pressurized by the pressurizing mechanism to the liquid ejecting unit.

In the liquid ejecting apparatus, it is preferable that the valve opening mechanism include an expansion and contraction unit which can perform expansion and contraction, and can press the diaphragm section in an expanded state, in the fluid chamber which is formed so as to cover the second face of the diaphragm section, press the diaphragm section in a direction in which a volume of the liquid accommodation part decreases, and set the on-off valve to the open state by expanding the expansion and contraction unit.

According to the configuration, the valve opening mechanism presses the diaphragm section in a direction in which the volume of the liquid accommodation part decreases, by causing the expansion and contraction unit to be expanded. For this reason, the valve opening mechanism can preferably perform pressing of the diaphragm section.

In the liquid ejecting apparatus, it is preferable that the valve opening mechanism press the pressure receiving portion in the diaphragm section.

According to the configuration, since the valve opening mechanism presses the pressure receiving portion in the diaphragm section, it is possible to reduce a concern that the annular corrugated portion may be reversed, compared to a case in which a portion other than the pressure receiving portion is pressed. Accordingly, it is possible to stabilize a displacement of the diaphragm section.

In the liquid ejecting apparatus, it is preferable that the valve opening mechanism include a pressure regulator which can regulate pressure in the fluid chamber which is formed on the second face side of the diaphragm section, and press the diaphragm section in a direction in which the volume of the liquid accommodation part decreases, and set the on-off valve to the open state, by regulating a pressure in the fluid chamber so as to be a pressure higher than atmospheric pressure.

According to the configuration, the valve opening mechanism presses the diaphragm section in a direction in which the volume of the liquid accommodation part decreases, by regulating pressure in the fluid chamber. For this reason, the valve opening mechanism can preferably set the on-off valve to an open state.

It is preferable that the liquid ejecting apparatus further include the valve opening mechanism which sets the on-off valve to an open state, and a contact portion which is provided inside the liquid accommodation part, and is provided so as to be in contact with the annular corrugated portion, in an open state of the on-off valve using the valve opening mechanism.

According to the configuration, it is possible to change a flow of liquid in the liquid accommodation part, in a case in which the diaphragm section is displaced so that the annular corrugated portion and the contact portion are in contact, and a case in which the diaphragm section is displaced so that the annular corrugated portion and the contact portion are not in contact.

According to another aspect of the invention, there is provided a pressure-regulating device including a pressure-regulating mechanism provided in a liquid supply path in which it is possible to supply liquid which is supplied from a liquid supply source to a liquid ejecting unit which ejects the liquid from a nozzle, in a state in which the liquid is pressurized, by driving an actuator, the pressure-regulating mechanism including a liquid inflow part into which the liquid supplied from the liquid supply source flows, a liquid accommodation part which can accommodate the liquid internally, and a volume of the liquid accommodation part is changed depending on displacing of a diaphragm section, a communication path through which the liquid inflow part and the liquid accommodation part communicate, and an on-off valve which enters an open state in which the liquid inflow part and the liquid accommodation part communicate from a closed state in which the liquid inflow part and the liquid accommodation part in the communication path do not communicate, when a pressure applied to a first face which is an inner face of the liquid accommodation part of the diaphragm section is lower than the pressure applied to a second face which is an outer face of the liquid accommodation part of the diaphragm section, and a difference between the pressure applied to the first face and the pressure applied to the second face is a predetermined value or more, in which the diaphragm section includes a pressure receiving portion which receives pressure at an on-off time of the on-off valve, and an annular corrugated portion which is formed in a sectional waveform shape, is provided between the pressure receiving portion and an outer edge portion of the diaphragm section, and is deformed when the diaphragm section receives pressure.

According to the configuration, it is possible to exhibit the same effect as that in the above-described liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, a first embodiment of a liquid ejecting apparatus and a pressure-regulating device will be described with reference to drawings.

Figure 1:
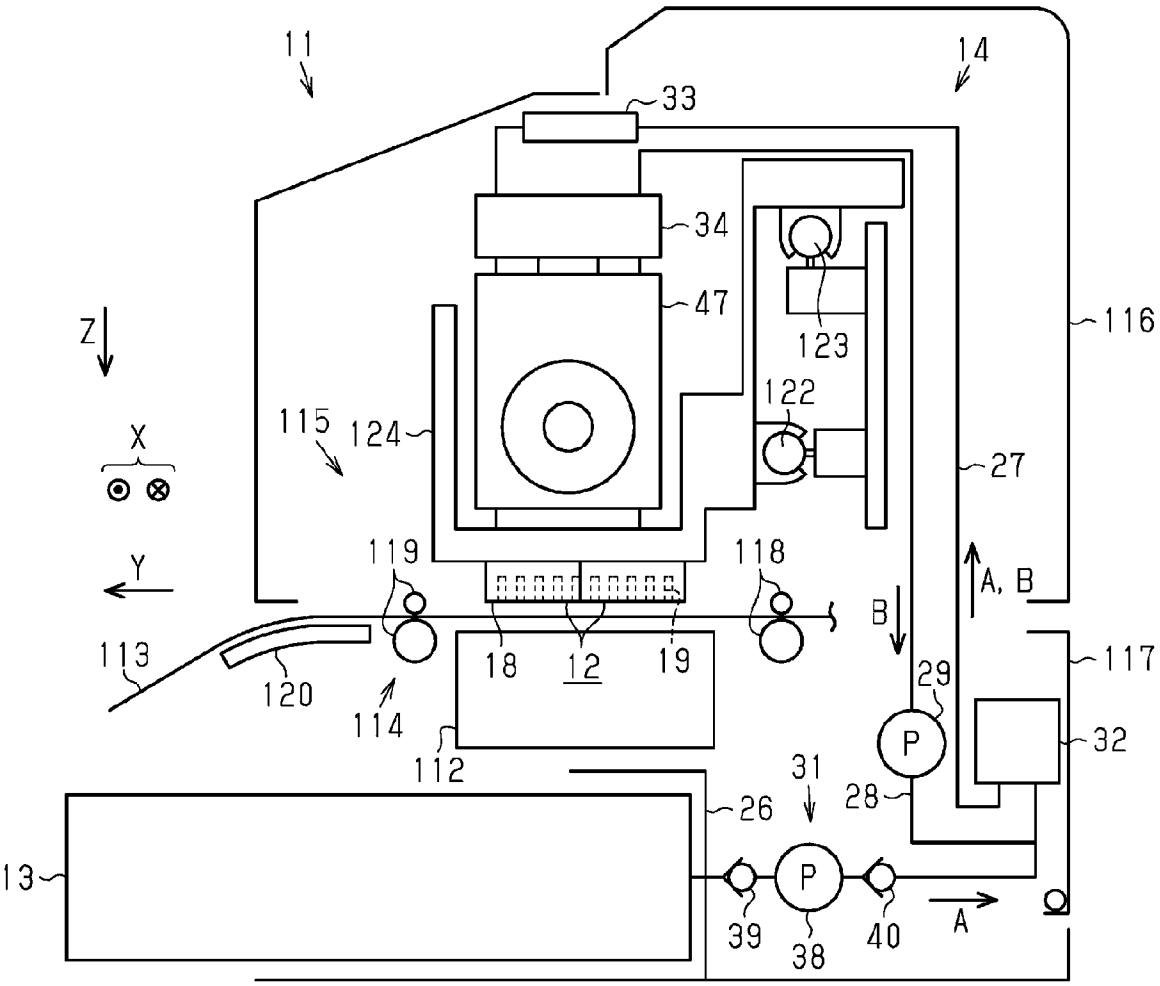
FIG. 1 is a schematic view in a first embodiment of a liquid ejecting apparatus.

As illustrated in FIG. 1, a liquid ejecting apparatus 11 is provided with a liquid ejecting unit 12 which ejects liquid, and a supply mechanism 14 which supplies the liquid to the liquid ejecting unit 12 from a liquid supply source 13 which is the supply source of the liquid. In addition, the liquid ejecting apparatus 11 is provided with a supporting table 112 which is disposed at a position facing the liquid ejecting unit 12, a transport unit 114 which transports a medium 113 in a transport direction Y. and a printing unit 115 which performs printing on the medium 113 by moving the liquid ejecting unit 12 in a scanning direction X. The supporting table 112 extends in a width direction (scanning direction X) of the medium 113 which is orthogonal to (intersect) the transport direction Y of the medium 113.

The supporting table 112, the transport unit 114, and the printing unit 115 are assembled in a main body 116 which is configured of a housing, a frame, or the like. In addition, a cover 117 is attached to the main body 116 in an openable and closeable manner.

The transport unit 114 is provided with pairs of transport rollers 118 and 119 which are respectively disposed on an upstream side and a downstream side of the supporting table 112 in the transport direction Y, and a guiding plate 120 which guides the medium 113 disposed on the downstream side of the pair of transport roller 119. When the pairs of transport rollers 118 and 119 rotate while interposing the medium 113, by being driven by a transport motor (not illustrated), the medium 113 is transported along the surface of the supporting table 112 and the surface of the guiding plate 120, while being supported by the supporting table 112 and the guiding plate 120.

The printing unit 115 is provided with guide shafts 122 and 123 which extend along the scanning direction X, and a carriage 124 which can reciprocate in the scanning direction X by being guided by the guide shafts 122 and 123. The carriage 124 moves along with driving of a carriage motor (not illustrated).

At least one liquid ejecting unit 12 (two in the embodiment) is attached to an end portion of the carriage 124 on the vertical direction Z side. That is, the liquid ejecting units 12 are separated by a predetermined interval in the scanning direction X, and are disposed so as to be shifted by a predetermined distance in the transport direction Y. In addition, the liquid ejecting unit 12 ejects liquid from a plurality of nozzles 19 which are formed on a nozzle forming face 18.

Figure 2:
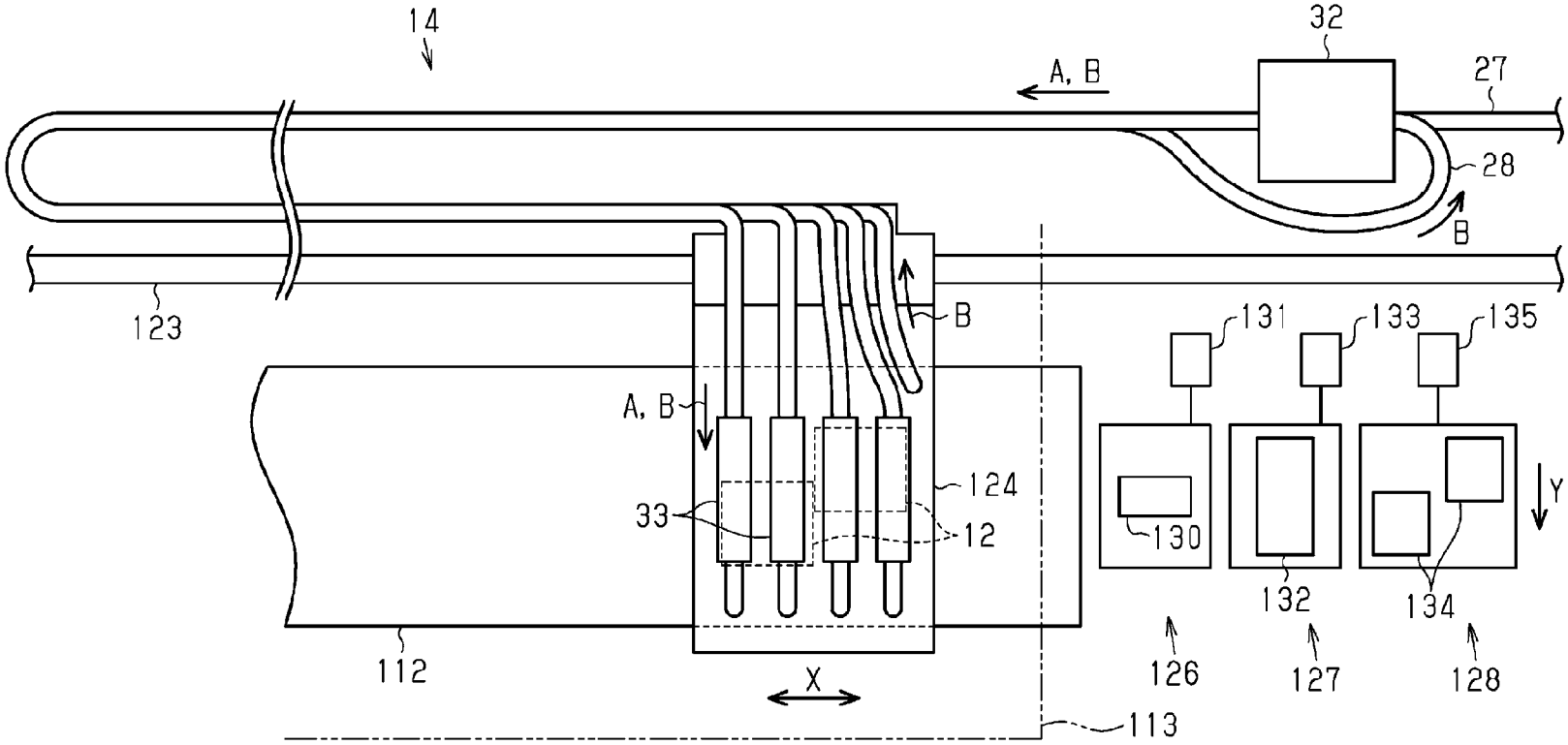
FIG. 2 is a schematic plan view in a printing region and a non-printing region.

As illustrated in FIG. 2, a wiper unit 126, a flushing unit 127, and a cap unit 128 are provided in a non-printing region in which the liquid ejecting unit 12 does not face the medium 113 which is being transported, in the scanning direction X.

The wiper unit 126 includes a wiper 130 which wipes the nozzle forming face 18. The wiper 130 according to the embodiment is a movable type, and performs a wiping operation using power of a wiping motor 131.

The flushing unit 127 includes a liquid receiving portion 132 which accommodates ink. The liquid receiving portion 132 is configured of a movable belt, and moves using power of a flushing motor 133. In addition, flushing is an operation in which ink droplets are forcibly ejected (discharged) from the entire nozzle 19, regardless of printing, in order to prevent or settle clogging of the nozzle 19, or the like.

The cap unit 128 is provided with two caps 134 which cover an opening of each nozzle 19 of two liquid ejecting units 12, and a capping motor 135 which causes the cap 134 to move up and down.

Figure 3:
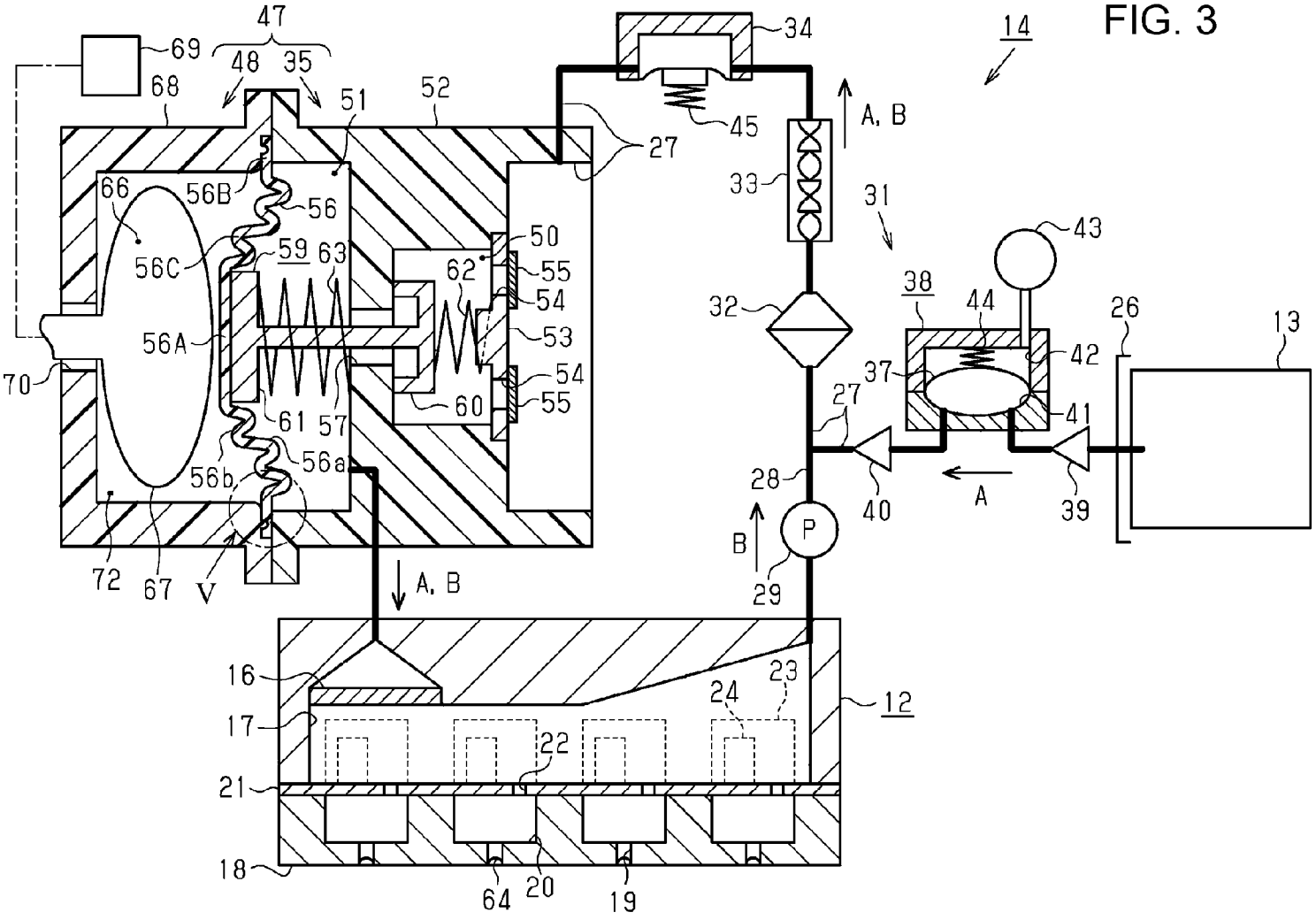
FIG. 3 is a schematic view of a pressure-regulating device and a supply mechanism in a state in which an on-off valve is closed.

As illustrated in FIG. 3, the liquid ejecting unit 12 is provided with a liquid ejecting unit filter 16 which captures air bubbles or foreign materials in liquid, and a common liquid chamber 17 which stores liquid which passes through the liquid ejecting unit filter 16. The liquid ejecting unit 12 is further provided with a plurality of pressure chambers 20 by which a plurality of nozzles 19 formed on the nozzle forming face 18 and the common liquid chamber 17 are communicated. A part of wall face of the pressure chamber 20 is formed by a vibrating plate 21, and the common liquid chamber 17 and the pressure chamber 20 communicate through a communication hole 22. An actuator 24 which is accommodated in an accommodation chamber 23 is provided at a position different from the common liquid chamber 17 which is a face on a side opposite to a portion which faces the pressure chamber 20, in the vibrating plate 21.

The actuator 24 is a piezoelectric element which contracts in a case in which a driving voltage is applied, for example. When application of the driving voltage is released after the vibrating plate 21 is deformed along with contraction of the actuator 24, liquid in the pressure chamber 20 in which a volume is changed is ejected from the nozzles 19 as liquid droplets. That is, the liquid ejecting unit 12 ejects liquid from the nozzle 19 by driving the actuator 24.

The liquid supply source 13 is an accommodation container which can accommodate the liquid, and may be a cartridge which replenishes the liquid by replacing the accommodation container, or may be an accommodation tank fixed to a mounting section 26. The mounting section 26 holds the liquid supply source 13 to be detachable in a case in which the liquid supply source 13 is a cartridge. At least one set of liquid supply source 13 and the supply mechanism 14 (in the embodiment, four sets) is provided per type of liquid ejected from the liquid ejecting unit 12.

The supply mechanism 14 is provided with a liquid supply path 27 in which it is possible to supply liquid supplied from the liquid supply source 13, as an upstream side in a supply direction A of liquid to the liquid ejecting unit 12, as a downstream side in a pressurized state. A part of the liquid supply path 27 also functions as a circulation path in cooperation with a circulation path forming section 28. That is, the circulation path forming section 28 connects the common liquid chamber 17 and the liquid supply path 27. In addition, a circulating pump 29 which causes liquid to circulate in a circulation direction B in the circulation path is provided in the circulation path forming section 28.

A pressurizing mechanism 31 which pressurizes and supplies the liquid toward the liquid ejecting unit 12 by causing the liquid to flow from the liquid supply source 13 in the supply direction A is provided in the liquid supply path 27 closer to the liquid supply source 13 side than the position at which the circulation path forming section 28 is connected. A filter unit 32, a static mixer 33, a liquid storage unit 34, and a pressure-regulating mechanism 35 are further provided in the liquid supply path 27, in order from the upstream side, at a portion that also functions as the circulation path further to the downstream side than the position at which the circulation path forming section 28 is connected.

The pressurizing mechanism 31 is provided with a volumetric pump 38 which applies pressure to the liquid while a flexible member 37 having flexibility is reciprocated and one way valves 39 and 40 provided to the upstream and the downstream of the volumetric pump 38, respectively, in the liquid supply path 27.

The volumetric pump 38 includes a pump chamber 41 and a negative pressure chamber 42 divided by the flexible member 37. The volumetric pump 38 is further provided with a pressure reduction unit 43 for reducing pressure of the negative pressure chamber 42 and a biasing member 44 which biases the flexible member 37 provided in the negative pressure chamber 42 toward the pump chamber 41 side. The one-way valves 39 and 40 permit the flow of the liquid from the upstream side to the downstream side in the liquid supply path 27 and regulate the flow of the liquid from the downstream side toward the upstream side. That is, the pressurizing mechanism 31 can pressurize the liquid supplied to the pressure-regulating mechanism 35 by the biasing member 44 biasing the liquid in the pump chamber 41 through the flexible member 37. Therefore, the pressurizing force at which the pressurizing mechanism 31 pressurizes the liquid is set by the biasing force of the biasing member 44.

The filter unit 32 captures air bubbles or foreign materials in liquid, and is provided so as to be exchanged when the cover 117 is opened (refer to FIG. 1). In addition, the static mixer 33 causes changes such as a change in direction or division in a flow of liquid, and reduces bias of concentration in the liquid. The liquid storage unit 34 stores liquid in a space of which a volume is variable, and is biased by a spring 45, and alleviates a fluctuation in pressure of liquid.

Subsequently, the pressure-regulating device 47 will be described.

As illustrated in FIG. 3, the pressure-regulating device 47 is provided with a pressure-regulating mechanism 35 which is provided in the liquid supply path 27, and which forms a part of the liquid supply path 27, and the valve opening mechanism 48 which is bonded to the pressure-regulating mechanism 35.

The pressure-regulating mechanism 35 is provided with a main body unit 52 in which the liquid inflow unit (the liquid inflow part) 50 into which the liquid supplied from the liquid supply source 13 flows through the liquid supply path 27, and the liquid accommodation unit (the liquid accommodation part) 51 which can accommodate the liquid in the inside thereof are formed. The liquid supply path 27 and the liquid inflow unit 50 are partitioned by a wall section 53, and communicate by means of a through hole 54 formed in the wall section 53. The through hole 54 is blocked by the filter member 55. That is, the liquid in the liquid supply path 27 flows into the liquid inflow unit 50 through the filter member 55. In addition, a part of the wall face of the liquid accommodation unit 51 is configured of the diaphragm section 56. In addition, the liquid inflow unit 50 and the liquid accommodation unit 51 are communicated, using a communication path 57.

The pressure-regulating mechanism 35 is provided with an on-off valve 59 which can switch between a closed state (state illustrated in FIG. 3) in which the liquid inflow unit 50 and the liquid accommodation unit 51 do not communicate in the communication path 57 and an open state (state illustrated in FIG. 7) in which the liquid inflow unit 50 and the liquid accommodation unit 51 communicate. The on-off valve 59 includes a valve unit 60 which can block the communication path 57, and a moving unit 61 which moves when receiving pressure from the diaphragm section 56. That is, the moving unit 61 is provided so as to move in a state of being in contact with the diaphragm section 56 which is displaced in a direction in which a volume of the liquid accommodation unit 51 is decreased.

An upstream side biasing member 62 is provided in the liquid inflow unit 50, and a downstream side biasing member 63 is provided in the liquid accommodation unit 51. The upstream side biasing member 62 and the downstream side biasing member 63 bias in the direction in which the on-off valve 59 is opened.

Figure 4:
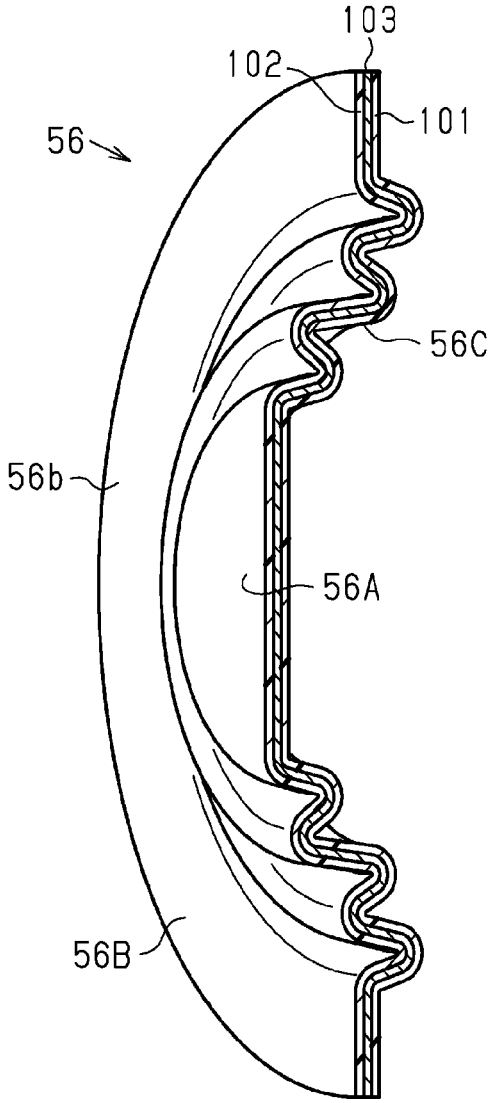
FIG. 4 is a sectional perspective view of a diaphragm section.

As illustrated in FIGS. 3 and 4, the diaphragm section 56 includes a pressure receiving portion 56A which receives pressure from the valve opening mechanism 48 at an on-off time of the on-off valve 59. The diaphragm section 56 is provided between the pressure receiving portion 56A and an outer edge portion 56B of the diaphragm section 56, and includes the annular corrugated unit (the annular corrugated portion) 56C which is formed in a sectional waveform shape, and is deformed when the diaphragm section 56 receives pressure. That is, a center portion of the diaphragm section 56 formed in an approximate disk shape is set to the pressure receiving portion 56A. In addition, in the annular corrugated unit 56C, a recessed portion and a projection portion of a concentric circle around the pressure receiving portion 56A are alternately formed from the pressure receiving portion 56A to the outer edge portion 56B. That is, in the diaphragm section 56, the first face 56*a* as an inner face of the liquid accommodation unit 51, and the second face 56*b* as an outer face of the liquid accommodation unit 51 are formed in a ripple shape.

The diaphragm section 56 includes a plurality of layers (three in the embodiment). Specifically, the diaphragm section 56 includes an inner layer 101 which is located inside the liquid accommodation unit 51, an outer layer 102 which is located outside the liquid accommodation unit 51, and a gas barrier layer 103 which is located between the inner layer 101 and the outer layer 102, and gas barrier properties thereof are higher than those of the inner layer 101 or the outer layer 102. That is, the inner layer 101 configures the first face 56*a*, and the gas barrier layer 103 is located on the second face 56*b* side, rather than the inner layer 101. In addition, the outer layer 102 configures the second face 56*b*, and the gas barrier layer 103 is provided on the first face 56*a* side, rather than the outer layer 102.

The inner layer 101 and the outer layer 102 are respectively formed by using a material which is selected from a group including polyethylene, polypropylene, polyester, polyphenylene sulfide, polyimide, and polyamide as a main component. The gas barrier layer 103 is formed by using silica (silicon dioxide) as a main component. In addition, the inner layer 101, the outer layer 102, and the gas barrier layer 103 are integrated, using bonding, vapor deposition, coating, or the like.

As illustrated in FIG. 3, the diaphragm section 56 receives atmospheric pressure on the second face 56*b*, while receiving pressure of liquid in the liquid accommodation unit 51 on the first face 56*a*. In addition, the diaphragm section 56 is displaced according to pressure in the liquid accommodation unit 51. A volume inside the liquid accommodation unit 51 is changed when the diaphragm section 56 is displaced.

The on-off valve 59 is put in the open state from the closed state when the pressure applied to the first face 56*a* is lower than the pressure applied to the second face 56*b* and the difference between the pressure applied to the first face 56*a* and the pressure applied to the second face 56*b* is a predetermined value (for example, 1 kPa) or more. The predetermined value is a value determined according to the biasing force of the upstream side biasing member 62, the biasing force of the downstream side biasing member 63, the force necessary for the diaphragm section 56 to be displaced, the pressing force (sealing load) necessary in order to block the communication path 57 with the valve unit 60, and the pressure in the liquid inflow unit 50 which acts on the face of the valve unit 60 and the pressure in the liquid accommodation unit 51. That is, the predetermined value increases as the biasing force of the upstream side biasing member 62 and the downstream side biasing member 63 increases. The biasing force of the upstream side biasing member 62 and the downstream side biasing member 63 are set so that the pressure in the liquid accommodation unit 51 is put in a negative pressure state (in a case in which the pressure applied to the second face 56*b* is atmospheric pressure, −1 kPa) in a range which can form meniscus 64 in the gas-liquid interface in the nozzle 19.

It should be noted that the gas-liquid interface is the boundary at which the liquid and the gas come in contact. The meniscus 64 a curved liquid face at which the liquid can contact the nozzle 19, and it is preferable that a recessed meniscus 64 suitable to ejection of the liquid be formed in the nozzle 19.

The valve opening mechanism 48 is provided with an expansion and contraction unit 67 which forms a pressure-regulating chamber 66 on the second face 56*b* side of the diaphragm section 56, a pressing member 68 which presses the expansion and contraction unit 67, and a pressure regulator 69 which can regulate a pressure in the pressure-regulating chamber 66.

The expansion and contraction unit 67 is formed in a balloon shape by a rubber or a resin, and can expand and contract in response to the pressure regulator 69 adjusting the pressure of the pressure-regulating chamber 66, The pressing member 68 is formed in a bottomed cylinder shape, and the expansion and contraction unit 67 is inserted into the insertion hole 70 formed in the bottom portion.

Figure 5:
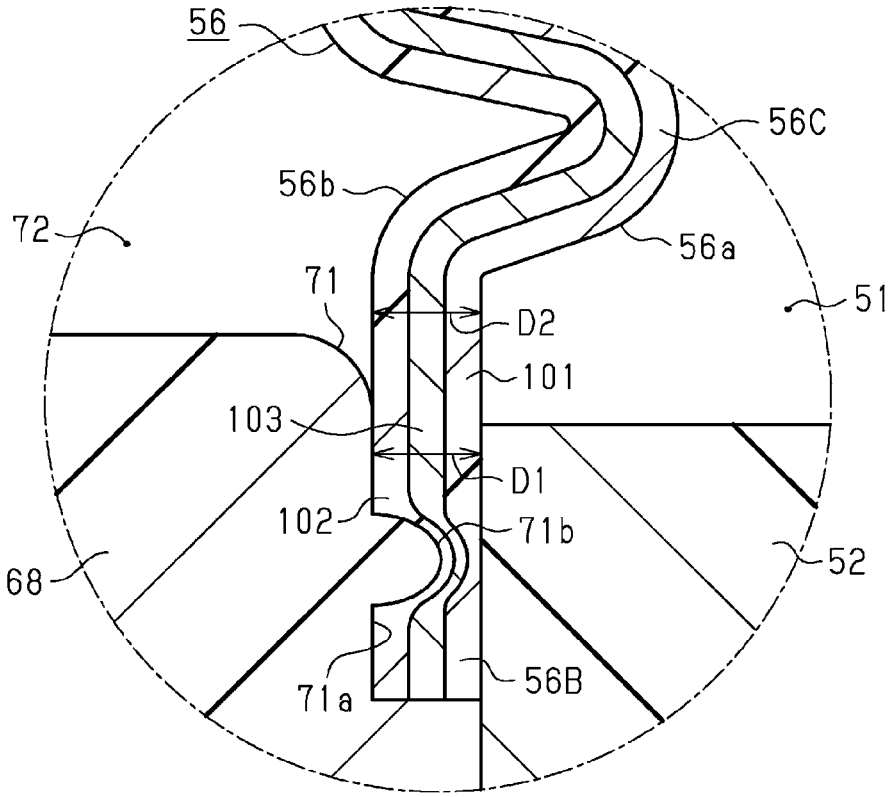
FIG. 5 is an enlarged view of a V portion in FIG. 3.

As illustrated in FIGS. 3 and 5, in the pressing member 68, roundness is formed on an end on an inner face on an opening 71 side, by being chamfered. An annular recessed portion 71*a* which is formed in an annular shape is formed in the opening 71, and a projection portion 71*b* is also formed in the annular recessed portion 71*a*. In addition, a size D1 (depth) of the annular recessed portion 71*a* is smaller than a size D2 (thickness) of the diaphragm section 56. For this reason, the diaphragm section 56 is pressed between the pressing member 68 and the main body unit 52 when the pressing member 68 is attached to the pressure-regulating mechanism 35.

As illustrated in FIG. 3, the pressing member 68 forms a fluid chamber 72 which covers the second face 56*b* of the diaphragm section 56, by being attached to the pressure-regulating mechanism 35 by setting so that the opening 71 is blocked by the pressure-regulating mechanism 35. In addition, the expansion and contraction unit 67 is accommodated in the fluid chamber 72. In addition, pressure in the fluid chamber 72 is set to atmospheric pressure, and the atmospheric pressure works on the second face 56*b* of the diaphragm section 56.

That is, the pressure regulator 69 causes the expansion and contraction unit 67 to be expanded, by regulating pressure in the pressure-regulating chamber 66 so as to be higher than the atmospheric pressure which is the pressure of the fluid chamber 72. In addition, the valve opening mechanism 48 presses the diaphragm section 56 in a direction in which a volume of the liquid accommodation unit 51 decreases, by causing the pressure regulator 69 to expand the expansion and contraction unit 67. At this time, the valve opening mechanism 48 presses the pressure receiving portion 56A in the diaphragm section 56. The moving unit 61 is provided at a position of being in contact with the pressure receiving portion 56A, and the valve opening mechanism 48 presses the moving unit 61 through the pressure receiving portion 56A. In addition, an area in the diaphragm section 56 in a region with which the moving unit 61 is in contact is larger than a sectional area of the communication path 57.

Figure 6:
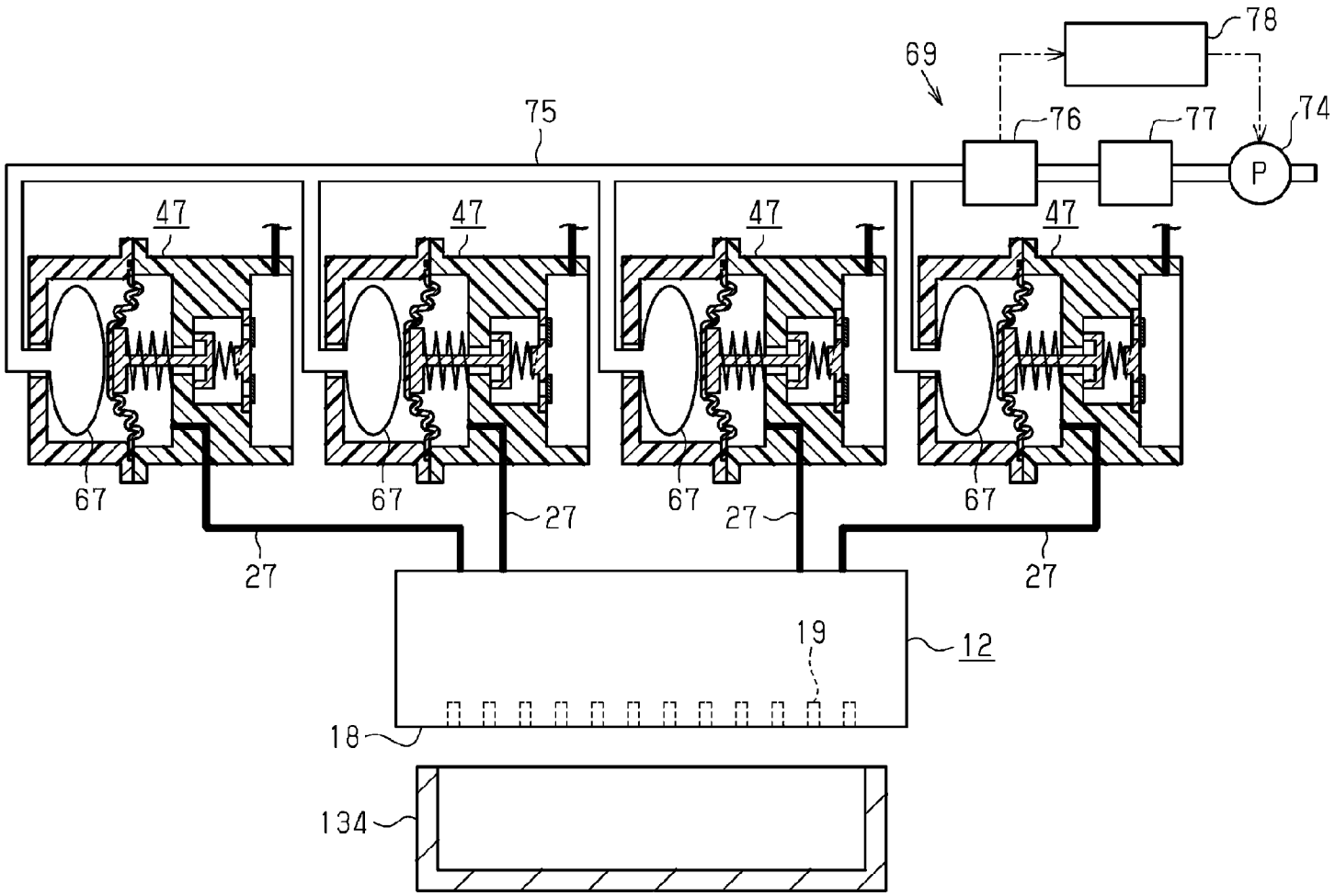
FIG. 6 is a schematic view of a plurality of pressure-regulating devices and a pressure regulator.

As illustrated in FIG. 6, the pressure regulator 69 is provided with a pressurizing pump 74 which pressurizes fluid, a connection path 75 which connects the pressurizing pump 74 and the expansion and contraction unit 67, and a detector 76 and a fluid pressure regulator 77 which are provided in the connection path 75. A downstream side of the connection path 75 is branched, and is respectively connected to the expansion and contraction unit 67 of the plurality of pressure-regulating device 47 (four in the embodiment).

That is, the fluid pressurized by the pressurizing pump 74 is supplied to each of the expansion and contraction units 67 through the connection path 75. The detector 76 detects the pressure of the fluid supplied in the connection path 75, and the fluid pressure regulator 77 adjusts the pressure sot that the fluid reaches a predetermined pressure by opening the valve and fluid escaping in a case there the pressure of the supplied fluid becomes higher than a predetermined pressure.

The liquid ejecting apparatus 11 is provided with a controller 78 which controls the driving of the pressurizing pump 74 based on the pressure of the fluid detected by the detector 76. The controller 78 also integrally controls the driving of each mechanism in the liquid ejecting apparatus 11.

Subsequently, an operation of the pressure-regulating device 47 which regulates pressure of liquid which is supplied to the liquid ejecting unit 12 will be described.

As illustrated in FIG. 3, when the liquid ejecting unit 12 ejects liquid, liquid accommodated in the liquid accommodation unit 51 is supplied to the liquid ejecting unit 12 through the liquid supply path 27. Then, a pressure in the liquid accommodation unit 51 decreases.

The diaphragm section 56 performs a flexural deformation in a direction in which a volume of the liquid accommodation unit 51 decreases, when a difference between the pressure applied to the first face 56*a* and the pressure applied to the second face 56*b* becomes large. In addition, when the moving unit 61 moves by being pressed along with a deformation of the diaphragm section 56, the on-off valve 59 enters an open state.

The liquid in the liquid inflow unit 50 is pressurized by the pressurizing mechanism 31. Therefore, when the on-off valve 59 opens, the liquid is supplied from the liquid inflow unit 50 to the liquid accommodation unit 51, and the pressure in the liquid accommodation unit 51 rises. Thus, the diaphragm section 56 is deformed so that the volume of the liquid accommodation unit 51 is increased. When the difference between the pressure applied to the first face 56*a* and the pressure applied to the second face 56*b* becomes lower than the predetermined value, the on-off valve 59 is put in the closed state from the open state, and the flow of the liquid is regulated.

In this manner, the pressure-regulating mechanism 35 regulates the pressure in the liquid ejecting unit 12 at which the nozzles 19 have back pressure by causing the diaphragm section 56 to be displaced, thereby regulating the pressure of the liquid supplied to the liquid ejecting unit 12.

Subsequently, the operation in a case in which pressurizing cleaning is performed by forcibly causing the liquid to flow from the liquid supply source 13 to the liquid ejecting unit 12, in order to perform maintenance of the liquid ejecting unit 12, will be described.

As illustrated in FIG. 6, the controller 78 drives the pressurizing pump 74, and supplies the pressurized fluid to the expansion and contraction unit 67.

Figure 7:
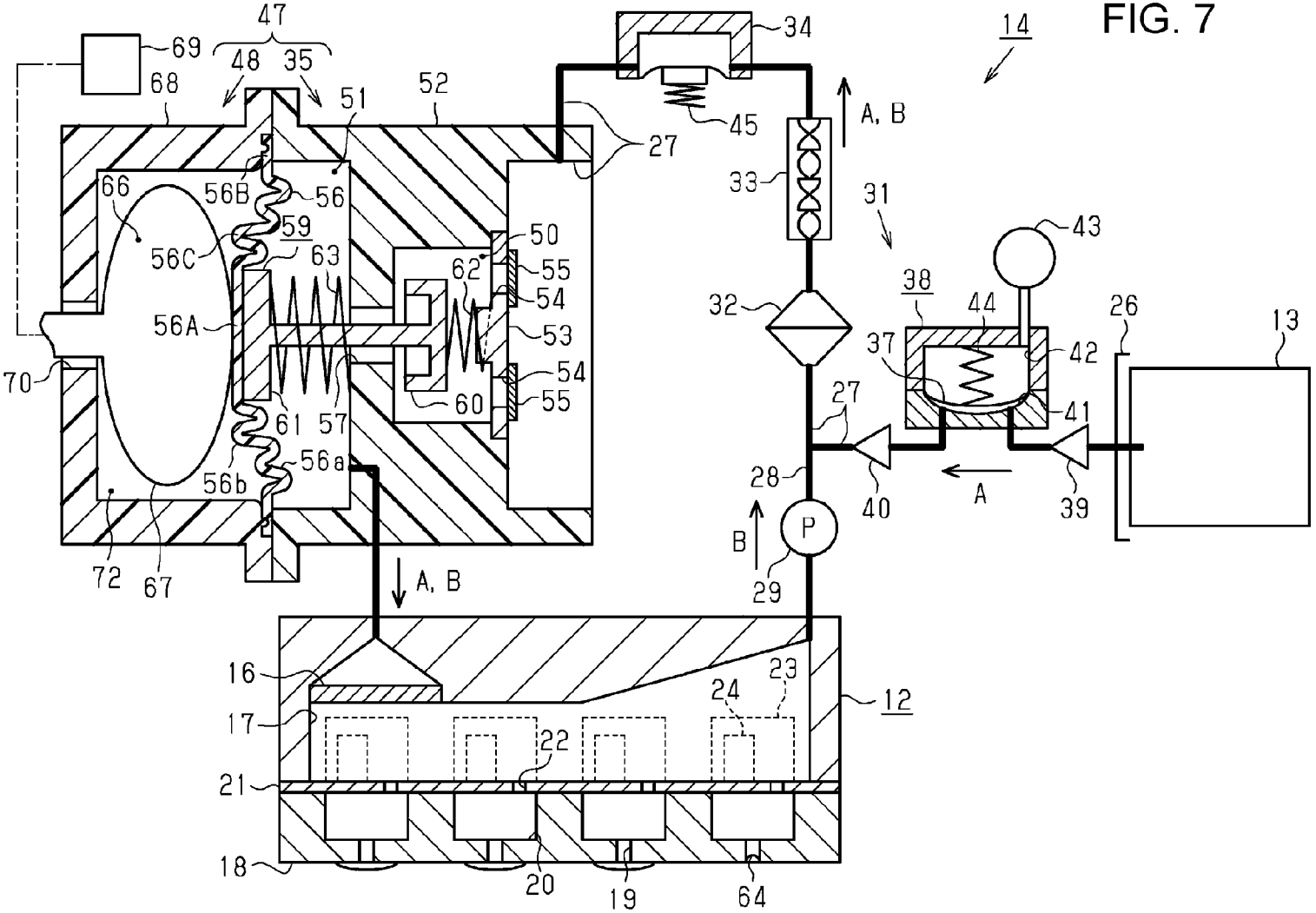
FIG. 7 is a schematic view of the pressure-regulating device and the supply mechanism in a state in which the on-off valve is opened.

As illustrated in FIG. 7, the expansion and contraction unit 67 to which fluid is supplied expands, and presses the pressure receiving portion 56A as a region with which the moving unit 61 comes in contact in the diaphragm section 56. That is, the valve opening mechanism 48 causes the on-off valve 59 to enter the open state, by moving the moving unit 61 against a biasing force of the upstream side biasing member 62 and the downstream side biasing member 63. Since the pressure regulator 69 is connected to the expansion and contraction unit 67 of the plurality of pressure-regulating devices 47, the on-off valves 59 of these pressure-regulating devices 47 enter the open state. That is, the valve opening mechanism 48 causes the on-off valve 59 to enter the open state.

Since the diaphragm section 56 is deformed in a direction in which the volume of the liquid accommodation unit 51 decreases, liquid accommodated in the liquid accommodation unit 51 is discharged to the liquid ejecting unit 12 side in a pressing manner. That is, the pressure obtained when the diaphragm section 56 presses the liquid accommodation unit 51 is transmitted to the liquid ejecting unit 12, the meniscus 64 is broken, and liquid overflows from the nozzle 19. That is, the valve opening mechanism 48 presses the diaphragm section 56 so that the pressure in the liquid accommodation unit 51 becomes larger than the pressure with which at least one meniscus 64 is broken (for example, at gas-liquid interface, pressure on liquid side becomes higher than pressure on gas side by 3 kPa). In addition, the valve opening mechanism 48 causes the on-off valve 59 to enter the open state, regardless of the pressure in the liquid inflow unit 50, by pressing the diaphragm section 56. That is, the valve opening mechanism 48 presses the diaphragm section 56 using a pressing force larger than a pressing force which occurs in a case in which a pressure obtained by adding the above-described predetermined value to a pressure with which the pressurizing mechanism 31 pressurizes liquid is added to the diaphragm section 56.

The liquid ejecting apparatus 11 supplies the liquid pressurized by the pressurizing mechanism 31 to the liquid ejecting unit 12, by periodically driving the pressure reduction unit 43, in the open state of the on-off valve 59 which is caused when the valve opening mechanism 48 presses the diaphragm section 56. That is, when the pressure in the negative pressure chamber 42 is reduced accompanying the driving of the pressure reduction unit 43, the flexible member 37 is deformed in the direction in which the volume of the pump chamber 41 increases. Thus, the liquid flows into the pump chamber 41 from the liquid supply source 13. When depressurizing by the pressure reduction unit 43 is released, the flexible member 37 is biased by the biasing member 44 in the direction in which the volume of the pump chamber 41 decreases. That is, the liquid in the pump chamber 41 is pressurized by the biasing member 44 through the flexible member 37, and is supplied to the downstream side of the liquid supply path 27 by passing through the one-way valve 40 on the downstream side.

Since the open state of the on-off valve 59 is maintained, when the pressurizing mechanism 31 pressurizes the liquid, the pressurizing force is transferred to the liquid ejecting unit 12 through the liquid inflow unit 50, the communication path 57, and the liquid accommodation unit 51, and the liquid is discharged from the nozzle 19.

In a case in which the pressurizing cleaning is finished, the liquid ejecting apparatus 11 releases the pressing state of the diaphragm section 56 by the valve opening mechanism 48, and causes the on-off valve 59 to enter the closed state, in the state in which the liquid is pressurized by the pressurizing mechanism 31. The liquid ejecting apparatus 11 drives the actuator 24 of the liquid ejecting unit 12 in the process of causing the on-off valve 59 to be changed from the open state to the closed state. That is, when the actuator 24 is driven, the liquid is ejected from the nozzle 19, and liquid of the ejected amount is supplied from the liquid accommodation unit 51 to the liquid ejecting unit 12. Therefore, the on-off valve 59 is closed in a state in which the liquid is caused to flow from the liquid inflow unit 50 to the liquid accommodation unit 51.

Thereafter, the liquid ejecting apparatus 11 performs wiping in which the wiper 130 is caused to wipe the nozzle forming face 18, and performs the flushing by driving the actuator 24. Then, the meniscus 64 is formed in the nozzle 19.

Subsequently, a manufacturing method of the pressure-regulating device 47 by bonding the pressure-regulating mechanism 35 and the valve opening mechanism 48 will be described.

As illustrated in FIG. 7, the main body unit 52 in the embodiment is formed of a light absorbent resin (for example, polypropylene) which generates heat by absorbing laser light, or a colored resin in which a coloring material which absorbs light is used.

The diaphragm section 56 has light-transmissivity of transmitting laser light, and flexibility. The diaphragm section 56 is formed by heating a planar sheet using a heater or hot wind, and deforming the sheet based on a mold. That is, in the diaphragm section 56, the annular corrugated unit 56C is formed by using, for example, vacuum forming in which forming is performed by depressurizing an interval between a mold and a sheet, pressure forming in which sheet is set to be in close contact with a mold by being pressurized, press forming in which a sheet is interposed between molds, or the like.

The pressing member 68 is formed by using a light transmissive resin (for example, polystyrene, or polycarbonate) which transmits laser light. That is, transparency of the diaphragm section 56 is higher than that of the main body unit 52, and is lower than that of the pressing member 68.

As illustrated in FIG. 7, first, the diaphragm section 56 is interposed by the pressing member 68 in which the expansion and contraction unit 67 is inserted in the insertion hole 70 and the main body unit 52 (interposing process). Laser light is radiated through the pressing member 68 (radiating process). Thus, the laser light which penetrates the pressing member 68 is absorbed by the main body unit 52, and heat is generated. The main body unit 52, the diaphragm section 56, and the pressing member 68 are welded by the generated heat. Therefore, the pressing member 68 also functions as a jig which presses the diaphragm section 56, when manufacturing the pressure-regulating device 47.

According to the first embodiment, it is possible to obtain the following effects.

(1) In the diaphragm section 56, the annular corrugated unit 56C is deformed according to a difference in pressure which is applied to the first face 56*a* and the second face 56*b*. That is, since it is possible to cause the diaphragm section 56 to deform without bending the diaphragm section 56 when bonding the diaphragm section 56, it is possible to reduce creases which occur in a case of bonding the diaphragm section 56. For this reason, for example, even in a case in which cleaning is performed by being supplied with liquid pressurized by the pressurizing mechanism 31, it is possible to stabilize deforming of the diaphragm section 56. Accordingly, it is possible to stably open or close the on-off valve 59 which is opened or closed along with a deformation of the diaphragm section 56.

(2) Since the diaphragm section 56 is configured of the plurality of layers including the gas barrier layer 103, it is possible to reduce a concern that gas which penetrates the diaphragm section 56 may enter the liquid accommodation unit 51.

(3) Since the valve opening mechanism 48 can forcibly set the on-off valve 59 to the open state, it is possible to preferably perform cleaning of the liquid ejecting unit 12, by supplying liquid pressurized by the pressurizing mechanism 31 to the liquid ejecting unit 12.

(4) The valve opening mechanism 48 presses the diaphragm section 56 in a direction in which a volume of the liquid accommodation unit 51 decreases, by expanding the expansion and contraction unit 67. For this reason, the valve opening mechanism 48 can preferably perform pressing of the diaphragm section 56.

(5) Since the valve opening mechanism 48 presses the pressure receiving portion 56A in the diaphragm section 56, it is possible to reduce a concern that the annular corrugated unit 56C may be reversed, compared to a case in which a portion other than the pressure receiving portion 56A is pressed. Accordingly, it is possible to stabilize a displacement of the diaphragm section 56.

Second Embodiment

Subsequently, a second embodiment of the liquid ejecting apparatus will be described with reference to drawings. A pressurizing mechanism in the second embodiment is different from the case of the first embodiment. Since other features are substantially the same as those in the first embodiment, the same configurations are given the same reference numerals and redundant descriptions will be omitted.

Figure 8:
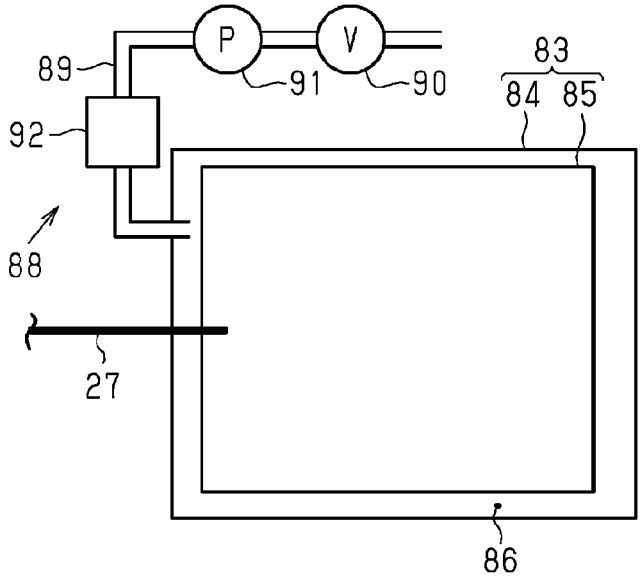
FIG. 8 is a schematic view of a pressurizing mechanism in a liquid ejecting apparatus in a second embodiment.

As illustrated in FIG. 8, the liquid supply source 83 is formed of an outer case 84 which is formed in an airtight state, and a liquid pack 85 which is accommodated in the outer case 84, and can be deformed in a state in which liquid is sealed, and a space between the outer case 84 and the liquid pack 85 is set to a pressurizing chamber 86.

A pressurizing mechanism 88 pressurizes liquid supplied to the pressure-regulating mechanism 35, by pressurizing the pressurizing chamber 86. That is, the pressurizing mechanism 88 is provided with a pressurizing path 89 which is connected to the pressurizing chamber 86, a release valve 90 which is provided on the pressurizing path 89, a supply pump 91, and an air pressure regulator 92. In addition, the release valve 90 permits flowing of air on the pressurizing path 89 by being opened, and regulates flowing of air by being closed. The supply pump 91 supplies air to the pressurizing chamber 86 through the pressurizing path 89. The air pressure regulator 92 regulates a pressure of supplied air, similarly to the fluid pressure regulator 77 which is provided in the valve opening mechanism 48.

The pressurizing chamber 86 is pressurized when the supply pump 91 is driven in a state in which the release valve 90 is opened. The pressurizing chamber 86 is maintained at the pressurized state by the release valve 90 which is opened in a state in which the supply pump 91 pressurizes the pressurizing chamber 86.

Subsequently, the operation in a case in which pressure cleaning is performed by forcibly causing the liquid to flow from the liquid supply source 83 to the liquid ejecting unit 12 in order to perform maintenance of the liquid ejecting unit 12 will be described.

The liquid ejecting apparatus 11 drives the valve opening mechanism 48, similarly to the first embodiment, thereby causing the on-off valve 59 to be opened. In the open state of the on-off valve 59, the pressurizing force which pressurizes the liquid using the pressurizing mechanism 88 is changed. That is, after the liquid is pressurized by a first pressurizing force, by driving the supply pump 91, for example, the controller 78 pressurizes liquid using a second pressurizing force which is different from the first pressurizing force, by changing driving of the supply pump 91. The first pressurizing force may be higher or lower than the second pressurizing force.

When the pressurizing force is changed, the flow rate, which is the amount of liquid ejected from the liquid ejecting unit 12 while flowing in the liquid supply path 27 per unit time, changes. That is, the flow rate in a case in which the liquid is pressurized at the first pressurizing force which is higher than the second pressurizing force is greater than the flow rate in a case in which the liquid is pressurized at the second pressurizing force.

According to the second embodiment, it is possible to obtain the following effects, in addition to the effects (1) to (5) according to the first embodiment.

(6) Since it is possible to set the on-off valve 59 to the open state, regardless of pressure in the liquid inflow unit 50, the on-off valve 59 can be maintained at the open state, even when a pressurizing force which pressurizes liquid using the pressurizing mechanism 88 is changed. Accordingly, it is possible to further preferably perform cleaning, since liquid can be supplied, using a pressurizing force corresponding to a state of the liquid ejecting unit 12, for example.

Third Embodiment

Subsequently, a third embodiment of the liquid ejecting apparatus will be described with reference to drawings. In the third embodiment, the pressure-regulating device is different from those in the first embodiment and the second embodiment. In addition, since other features are substantially the same as those in the first embodiment and the second embodiment, the same configurations are given the same reference numerals and redundant descriptions will be omitted.

Figure 9:
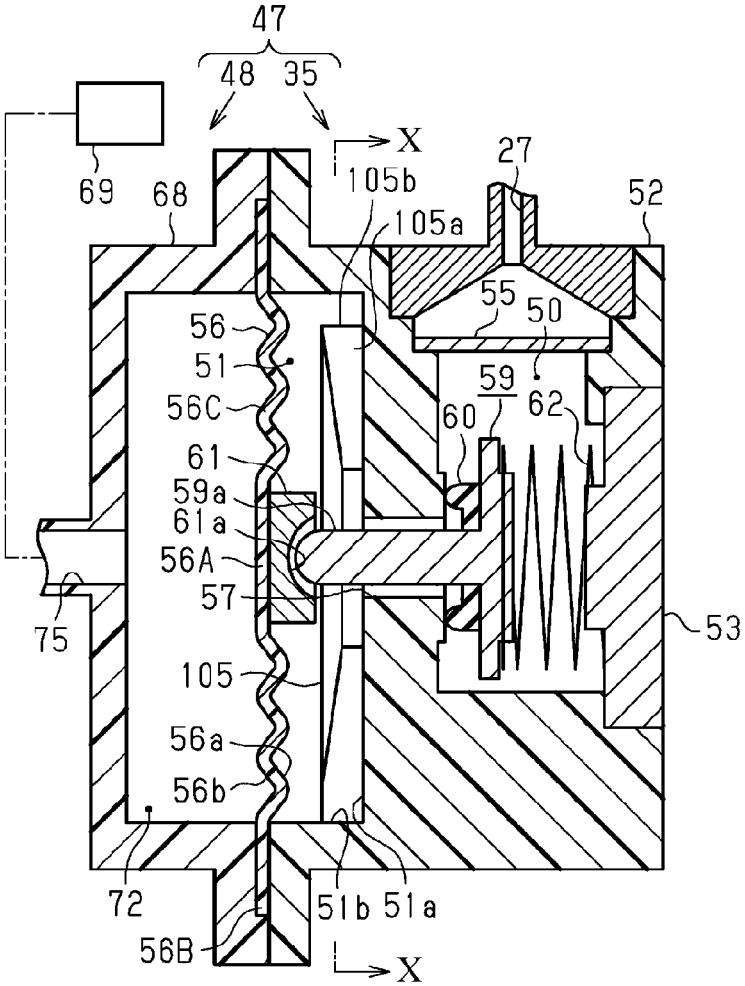
FIG. 9 is a schematic view of a pressure-regulating device in a liquid ejecting apparatus in a third embodiment.

As illustrated in FIG. 9, the liquid supply path 27 is connected to the liquid inflow unit 50 at a position different from the wall section 53 which supports the upstream side biasing member 62 through the filter member 55. In the on-off valve 59, the moving unit 61 and the valve unit 60 are respectively provided, as separate members. The moving unit 61 is integrated with the diaphragm section 56. Specifically, the moving unit 61 is bonded onto the first face 56*a* side in the pressure receiving portion 56A. In addition, an engaging recessed portion 61*a* which can be engaged with a projection portion 59*a* is formed in the moving unit 61.

The connection path 75 is connected to the fluid chamber 72. That is, the valve opening mechanism 48 includes the pressure regulator 69 which can regulate pressure in the fluid chamber 72 which is formed on the second face 56*b* side of the diaphragm section 56. In addition, the valve opening mechanism 48 presses the entire second face 56*b* of the diaphragm section 56 in a direction in which a volume of the liquid accommodation unit 51 decreases, by regulating the pressure in the fluid chamber 72 so as to be a pressure higher than atmospheric pressure, and sets the on-off valve 59 to the open state (refer to FIG. 12).

Figure 10:
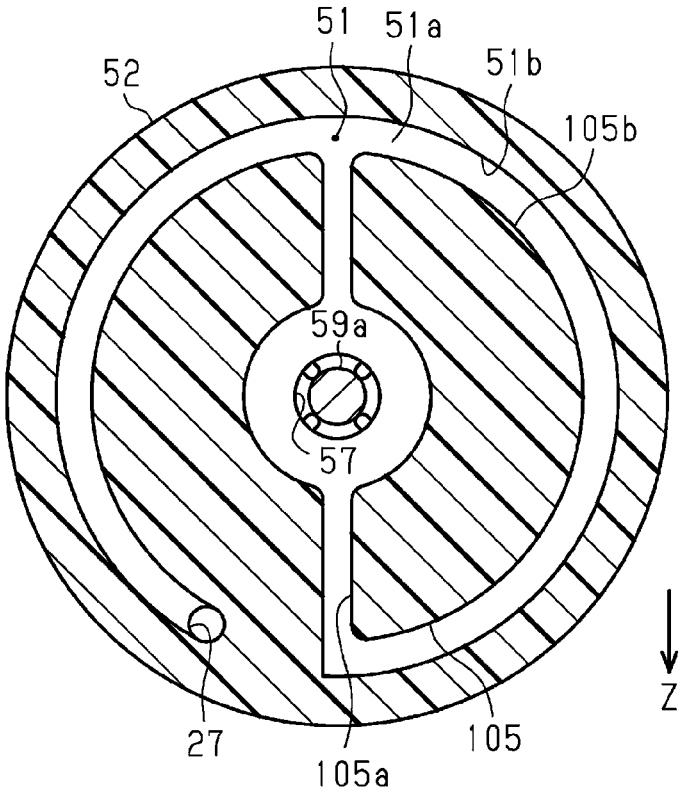
FIG. 10 is a sectional view taken along arrows X-X in FIG. 9.

As illustrated in FIGS. 9 and 10, in the liquid accommodation unit 51, a contact portion 105 which is provided so as to be in contact with the annular corrugated unit 56C is provided, in the open state of the on-off valve 59 (refer to FIG. 12) using the valve opening mechanism 48. That is, the contact portion 105 is formed so as to protrude toward the diaphragm section 56 side from a side wall portion 51*a* on which the communication path 57 is formed. The contact portion 105 is formed in an approximately annular shape, and a first groove portion 105*a* which extends (extends along vertical direction Z in the embodiment) in the vertical direction Z, by communicating with the communication path 57 is formed in a center portion of the contact portion 105. In addition, a second groove portion 105*b* is formed between the contact portion 105 and a peripheral wall portion 51*b* of the liquid accommodation unit 51. A lower end portion of the contact portion 105 in the vertical direction Z extends to the peripheral wall portion 51*b*. The contact portion 105 is formed so that a height thereof from the side wall portion 51*a* gradually decreases from the second groove portion 105*b* toward the center.

In the liquid accommodation unit 51, the liquid supply path 27 which causes liquid to flow out toward the liquid ejecting unit 12 side is formed beside the peripheral wall portion 51*b*, as a position in the liquid accommodation unit 51 which is higher than a lower end in the vertical direction Z. That is, the second groove portion 105*b* is formed so as to connect the first groove portion 105*a* and the liquid supply path 27 through the upper part of the liquid accommodation unit 51 in the vertical direction Z.

Subsequently, an operation of the pressure-regulating device 47 which regulates pressure of liquid which is supplied to the liquid ejecting unit 12 will be described.

Figure 11:
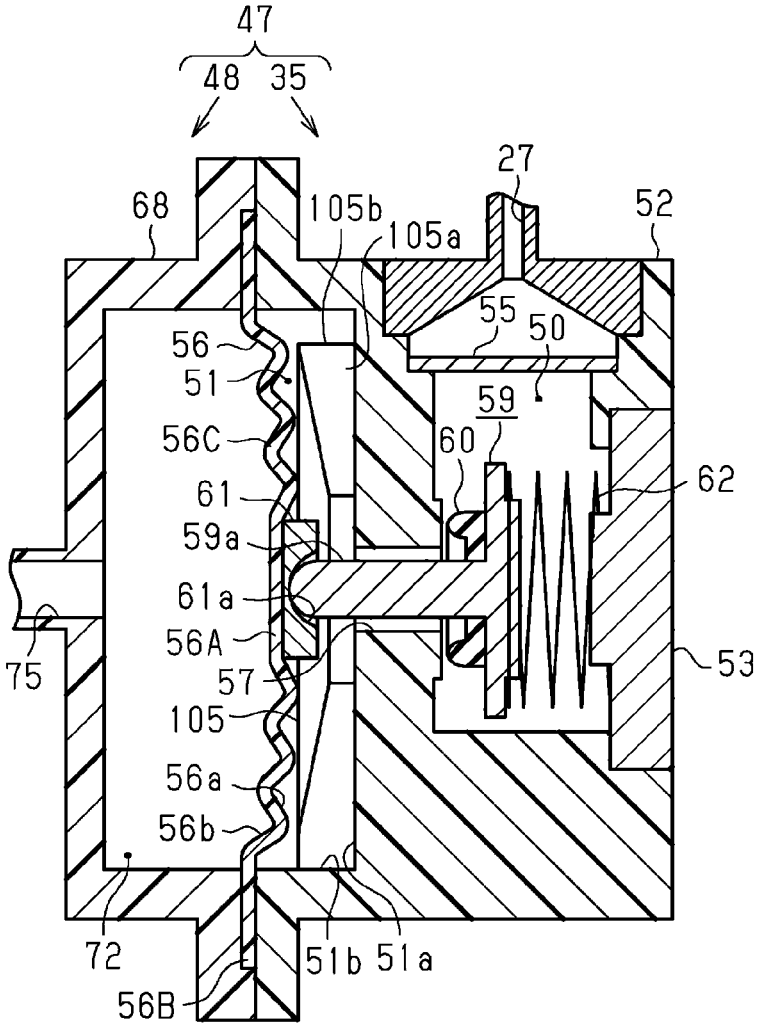
FIG. 11 is a schematic view of the pressure-regulating device in a state in which the on-off valve is opened.

As illustrated in FIG. 11, when the liquid ejecting unit 12 ejects liquid, liquid accommodated in the liquid accommodation unit 51 is supplied to the liquid ejecting unit 12 through the liquid supply path 27. Then, pressure in the liquid accommodation unit 51 decreases, and the diaphragm section 56 performs a flexural deformation in a direction in which a volume of the liquid accommodation unit 51 decreases. Then, the moving unit 61 which moves along with the diaphragm section 56 presses the projection portion 59*a*.

When the valve unit 60 moves, and the liquid inflow unit 50 and the communication path 57 communicate, liquid in the liquid inflow unit 50 which is pressurized by the pressurizing mechanism 31 is supplied to the liquid accommodation unit 51 through the communication path 57.

A displacement amount of the diaphragm section 56 at this time is smaller than that in a case in which the valve opening mechanism 48 presses the diaphragm section 56. For this reason, there is an interval between the diaphragm section 56 and the contact portion 105, and liquid supplied to the liquid accommodation unit 51 flows out from the liquid supply path 27 through the interval. Since a flow velocity at this time is lower than that when performing pressurizing cleaning, when air bubbles are included in the liquid supplied to the liquid accommodation unit 51, the air bubbles remain above the liquid accommodation unit 51.

The pressure-regulating mechanism 35 is not provided with the downstream side biasing member 63, and when pressure of the liquid accommodation unit 51 increases, the diaphragm section 56 is displaced from a position in which a volume of the liquid accommodation unit 51 decreases due to elasticity in a direction in which the volume increases.

Subsequently, an operation in a case of performing pressurizing cleaning by forcibly causing liquid to flow from the liquid supply source 13 to the liquid ejecting unit 12, for maintenance of the liquid ejecting unit 12, will be described.

Figure 12:
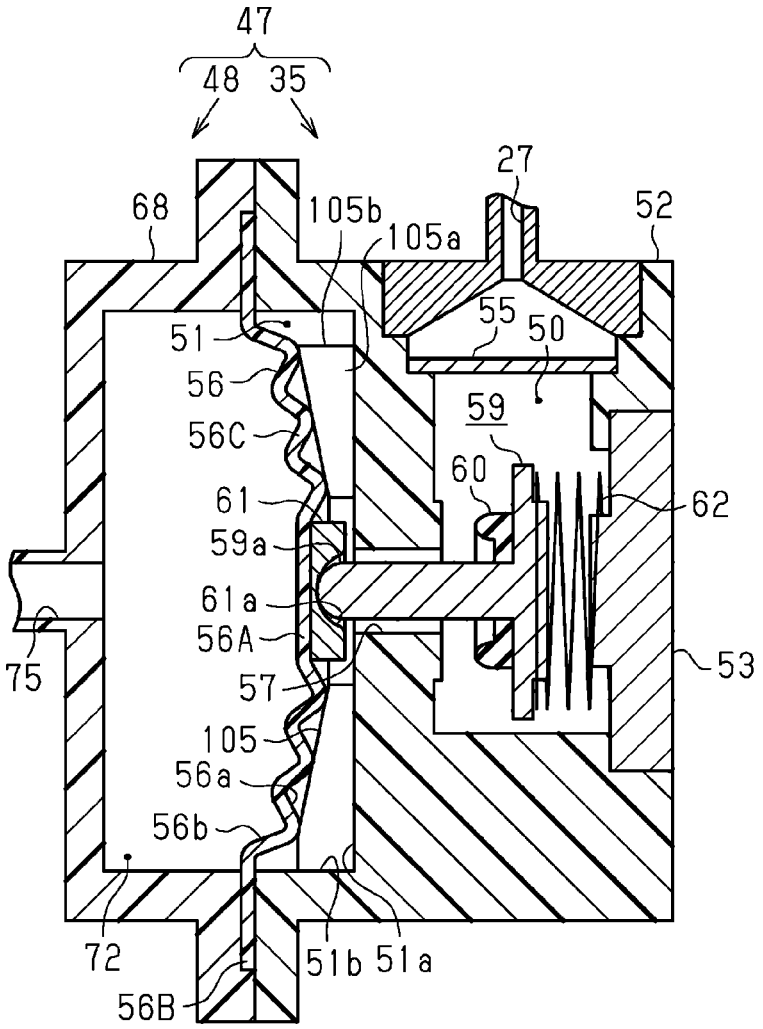
FIG. 12 is a schematic view of the pressure-regulating device when performing cleaning.

As illustrated in FIG. 12, the controller 78 drives the pressurizing pump 74, and supplies pressurized fluid to the fluid chamber 72. Then, the diaphragm section 56 performs a flexural deformation in a direction in which a volume of the liquid accommodation unit 51 decreases and sets the on-off valve 59 to the open state, and the annular corrugated unit 56C is in contact with the contact portion 105.

Figure 13:
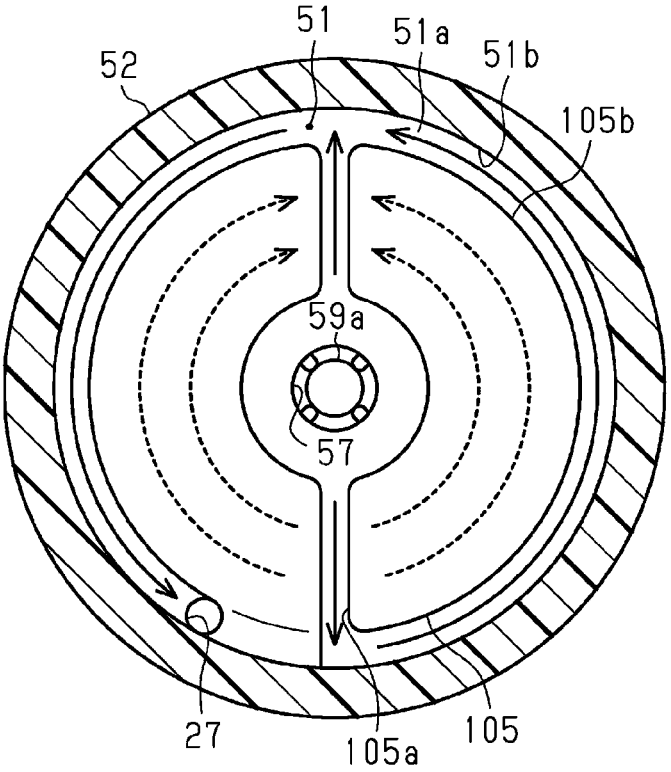
FIG. 13 is a schematic view of the liquid accommodation unit which describes a flow of liquid when performing cleaning.

As illustrated in FIG. 13, when the pressurized liquid is supplied to the liquid accommodation unit 51 through the communication path 57, the liquid flows in a space which is surrounded with the first groove portion 105*a*, the second groove portion 105*b*, and the diaphragm section 56, as denoted by a solid arrow. In addition, the liquid flows in a space which is surrounded with the contact portion 105 and the annular corrugated unit 56C, as denoted by a dotted arrow. That is, the liquid flows inside the liquid accommodation unit 51 so as to pass through the upper part of the liquid accommodation unit 51, flows out to the liquid supply path 27 along with air bubbles which remain in the upper part, and is discharged from the nozzle 19.

According to the third embodiment, it is possible to obtain the following effects, in addition to the effects (1) to (6) according to the first embodiment and the second embodiment.

(7) The valve opening mechanism 48 presses the diaphragm section 56 in a direction in which a volume of the liquid accommodation unit 51 decreases, by regulating pressure in the fluid chamber 72. For this reason, the valve opening mechanism 48 can preferably set the on-off valve 59 to the open state.

(8) It is possible to change a flow of liquid in the liquid accommodation unit 51 in a case in which the diaphragm section 56 is displaced so that the annular corrugated unit 56C and the contact portion 105 come into contact with each other, and in a case in which the diaphragm section 56 is displaced so that the annular corrugated unit 56C and the contact portion 105 do not come into contact with each other.

Fourth Embodiment

Subsequently, a fourth embodiment of the liquid ejecting apparatus will be described with reference to drawings. In the fourth embodiment, the pressure-regulating device is different from those in the first embodiment to the third embodiment. Since other features are substantially the same as those in the first embodiment to the third embodiment, the same configurations are given the same reference numerals, and redundant descriptions will be omitted.

Figure 14:
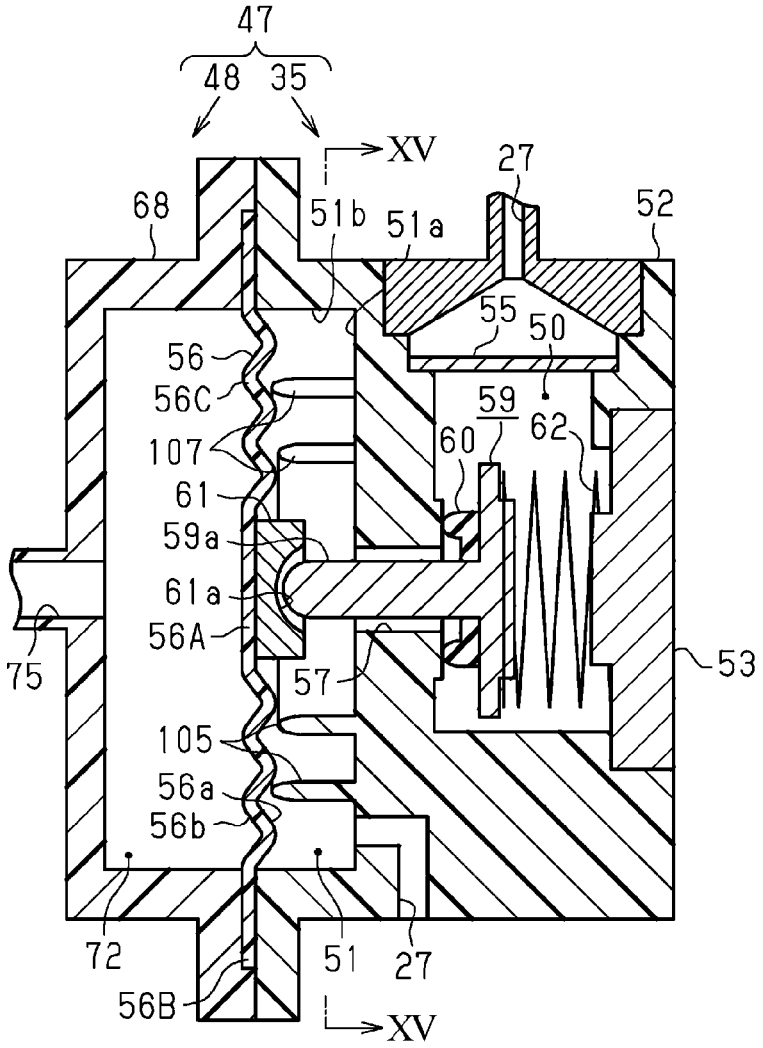
FIG. 14 is a schematic view of a pressure-regulating device in a liquid ejecting apparatus in a fourth embodiment.
Figure 15:
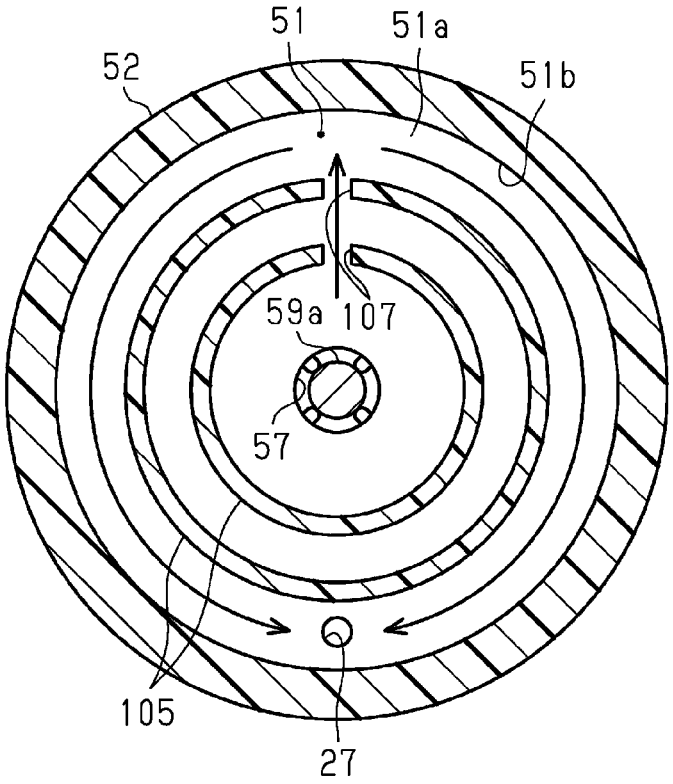
FIG. 15 is a sectional view taken along arrows XV-XV in FIG. 14.

As illustrated in FIGS. 14 and 15, the plurality of (two in the embodiment) contact portions 105 formed in an approximately annular shape, and with a different radius are formed in a radial direction by shifting positions thereof, in the inside of the liquid accommodation unit 51. In addition, a notch portion 107 is formed in the contact portion 105, in the upper part in the vertical direction Z.

Figure 16:
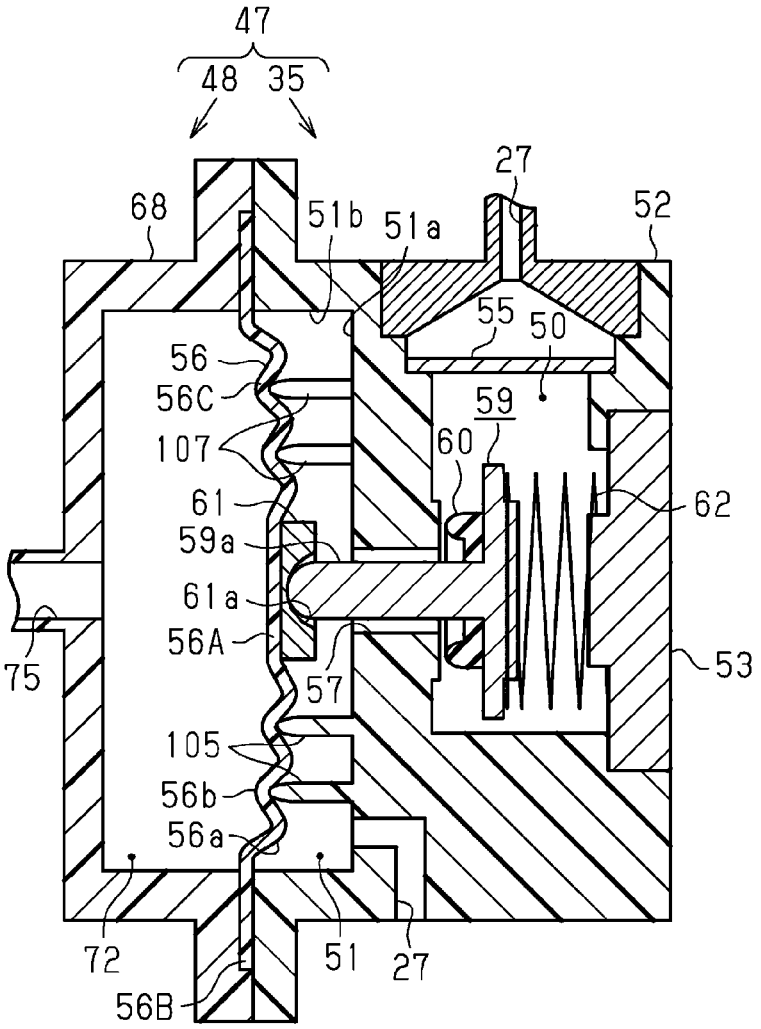
FIG. 16 is a schematic view of the pressure-regulating device when performing cleaning.

As illustrated in FIG. 16, the contact portion 105 is formed at a position corresponding to the recessed portion which is viewed from the first face 56*a* side of the annular corrugated unit 56C, when the diaphragm section 56 moves in a direction in which a volume of the liquid accommodation unit 51 is decreased.

Subsequently, an operation in a case in which pressurizing cleaning is performed by forcibly causing liquid to flow from the liquid supply source 13 to the liquid ejecting unit 12, in order to perform maintenance of the liquid ejecting unit 12 will be described.

As illustrated in FIG. 16, the controller 78 drives the pressurizing pump 74, and supplies pressurized fluid to the fluid chamber 72. Then, the diaphragm section 56 performs a flexural deformation toward the direction in which a volume of the liquid accommodation unit 51 decreases and sets the on-off valve 59 to the open state, and the annular corrugated unit 56C comes into contact with the contact portion 105.

As illustrated in FIG. 15, when pressurized liquid is supplied to the liquid accommodation unit 51 through the communication path 57, the liquid flows in the space which is surrounded with the contact portion 105, the peripheral wall portion 51*b*, and the diaphragm section 56, as denoted by a solid arrow, by passing through the notch portion 107. That is, the liquid flows in the liquid accommodation unit 51 so as to pass through the upper part of the liquid accommodation unit 51, and flows out to the liquid supply path 27 along with air bubbles which remain in the upper part.

According to the fourth embodiment, it is possible to obtain the following effects, in addition to the effects (1) to (8) according to the above-described first embodiment to third embodiment.

(9) For example, in a case in which the recess and projection of the annular corrugated unit 56C are reversed, it is possible to return the reversed state to a normal state, by causing the annular corrugated unit 56C and the contact portion 105 to be in contact.

Fifth Embodiment

Subsequently, a fifth embodiment of the liquid ejecting apparatus will be described with reference to drawings. In the fifth embodiment, the pressure-regulating device is different from those in the first to fourth embodiments. In addition, since other features are substantially the same as those in the first to fourth embodiments, the same configurations are given the same reference numerals, and redundant descriptions will be omitted.

Figure 17:
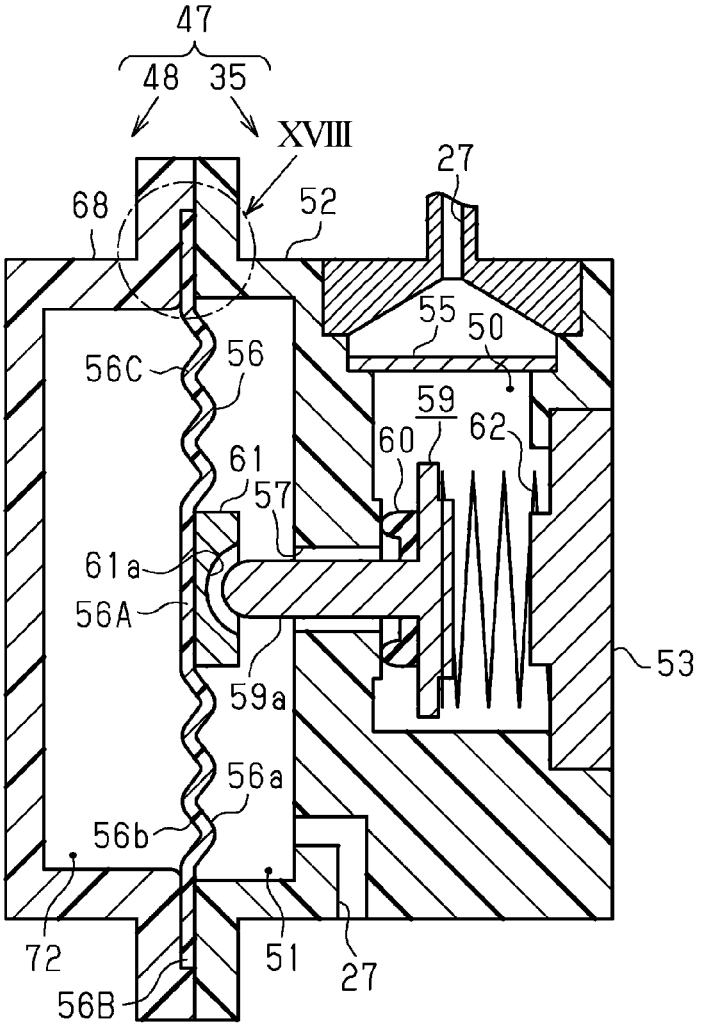
FIG. 17 is a schematic view of a pressure-regulating device in a liquid ejecting apparatus in a fifth embodiment.

As illustrated in FIG. 17, in the pressure-regulating mechanism 35, the fluid chamber 72 is formed by being attached with the pressing member 68 so as to cover the second face 56*b* of the diaphragm section 56. In addition, the diaphragm section 56 is configured of a single layer in which a material selected from a group including polyethylene, polypropylene, polyester, polyphenylene sulfide, polyimide, and polyamide is used as a main component.

Figure 18:
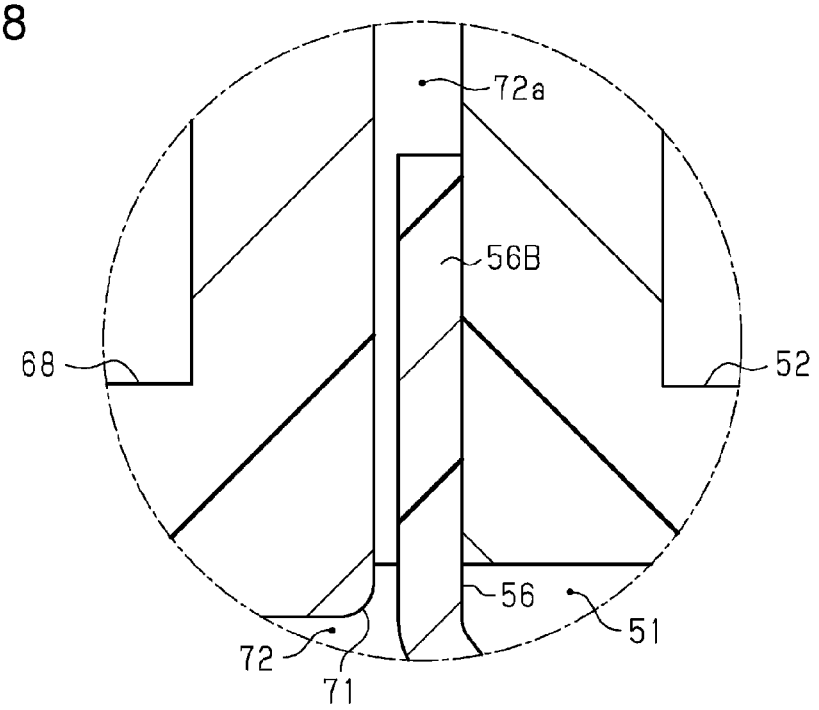
FIG. 18 is an enlarged view of an XVIII portion in FIG. 17.

As illustrated in FIG. 18, the fluid chamber 72 includes a fluid resistance unit 72*a* which disturbs flowing out of fluid from the fluid chamber 72. The fluid resistance unit 72*a* is a small cavity which is formed between the main body unit 52 and the pressing member 68, and causes the fluid chamber 72 and atmosphere to communicate.

Subsequently, an operation of the pressure-regulating device 47 which regulates pressure of liquid supplied to the liquid ejecting unit 12 will be described.

As illustrated in FIG. 17, the diaphragm section 56 is configured of a single layer, and does not include the gas barrier layer 103. For this reason, there is a case in which part of liquid which is accommodated in the liquid accommodation unit 51 penetrates the diaphragm section 56 by being vaporized. Since the second face 56*b* side of the diaphragm section 56 is set to the fluid chamber 72, gas (vapor) which penetrates the diaphragm section 56 remains inside the fluid chamber 72.

The diaphragm section 56 moves according to pressure in the liquid accommodation unit 51. That is, when the pressure in the liquid accommodation unit 51 decreases due to ejecting of liquid from the liquid ejecting unit 12, the diaphragm section 56 moves so that a volume of the liquid accommodation unit 51 is decreased. In addition, when liquid is supplied from the liquid inflow unit 50, and pressure in the liquid accommodation unit 51 increases, the diaphragm section 56 moves so that the volume of the liquid accommodation unit 51 is increased.

A volume of the fluid chamber 72 changes along with moving of the diaphragm section 56. That is, when the diaphragm section 56 is displaced in a direction in which the volume of the fluid chamber 72 is increased, atmosphere flows into the inside the fluid chamber 72 through the fluid resistance unit 72*a*. In addition, when the diaphragm section 56 is displaced in a direction in which the volume of the fluid chamber 72 is decreased, the fluid in the fluid chamber 72 flows out while receiving a resistance using the fluid resistance unit 72*a*.

According to the above-described fifth embodiment, it is possible to obtain the following effects, in addition to the effects (1) to (9) according to the first to fourth embodiments.

(10) For example, in a case in which the diaphragm section is configured by binding a plurality of films using an adhesive, it is necessary to form the annular corrugated unit 56C by taking a difference in a melting point, a thickness, or the like of each film into consideration. At this point, since the diaphragm section 56 is configured of a single layer of a preferable material, it is possible to easily form the annular corrugated unit 56C.

(11) By including the fluid chamber 72, it is possible to cause an evaporated solvent component to remain in the fluid chamber 72, even when the solvent component of liquid in the inside of the liquid accommodation unit 51 evaporates through the diaphragm section 56. That is, it is possible to make a humidity on the second face 56*b* side of the diaphragm section 56 high, by including the fluid chamber 72, compared to a case in which the fluid chamber 72 is not provided, and the solvent component diffuses into atmosphere. Accordingly, it is possible to suppress evaporation of the solvent component of liquid in the liquid accommodation unit 51. In addition, the fluid in the fluid chamber 72 flows out while receiving a resistance using the fluid resistance unit 72*a*. For this reason, it is possible to reduce a fluctuation of a pressure in the inside of the fluid chamber, while suppressing a decrease in humidity in the inside of the fluid chamber 72, even in a case in which the diaphragm section 56 is displaced.

The above-described embodiment may be modified as follows.

Figure 19:
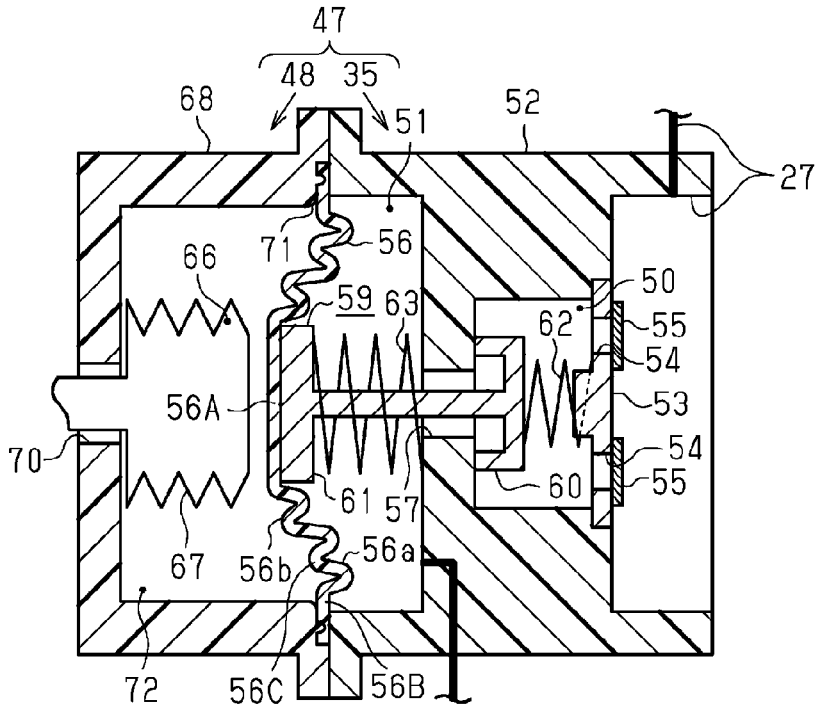
FIG. 19 is a schematic view in a first modification example of the pressure-regulating device.

As illustrated in FIG. 19, the expansion and contraction unit 67 may be a bellows, the side surface of which has an accordion fold shape (first modification example). That is, for the expansion and contraction unit 67, the bellows expands so that the accordion fold extends when the pressure-regulating chamber 66 and the bellows contracts when the pressure in the pressure-regulating chamber 66 is released.

Figure 20:
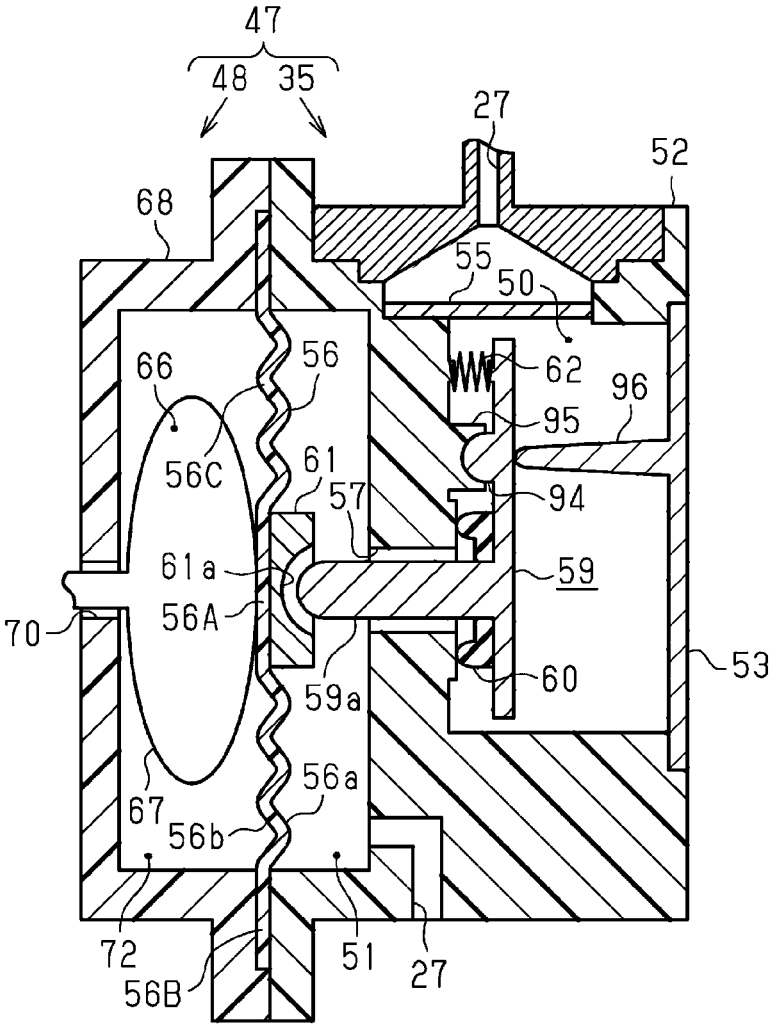
FIG. 20 is a schematic view in a second modification example of the pressure-regulating device.

As illustrated in FIG. 20, the on-off valve 59 may switch between the open state and the closed state by oscillating around a shaft 94 (second modification example). It is possible to stabilize a valve-opening operation of the on-off valve 59 compared to a case in which the on-off valve 59 is moved in a biasing direction of the upstream side biasing member 62, by oscillating the on-off valve 59. The on-off valve 59 is supported so that the shaft 94 is interposed between a bearing 95 and a support unit 96. In addition, in the on-off valve 59, the valve unit 60 is provided on one end side, rather than the shaft 94, and the other end side is biased by the upstream side biasing member 62. That is, the upstream side biasing member 62 biases the on-off valve 59 in a direction in which the valve unit 60 closes off the communication path 57.

Figure 21:
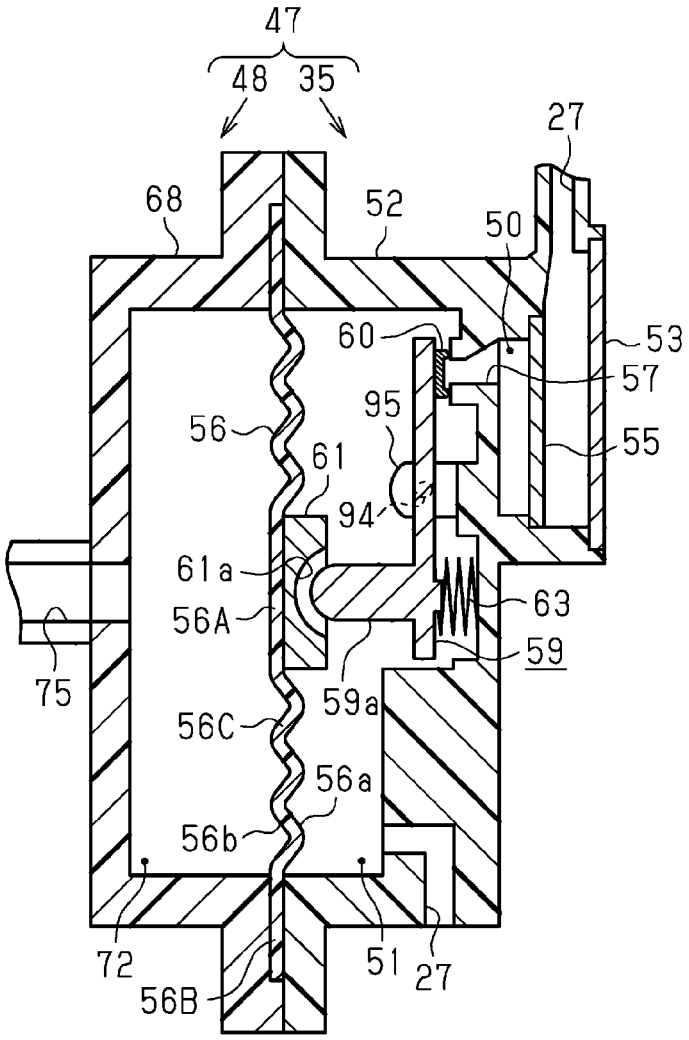
FIG. 21 is a schematic view in a third modification example of the pressure-regulating device.

As illustrated in FIG. 21, the on-off valve 59 may be provided in the liquid accommodation unit 51 (third modification example).

Figure 22:
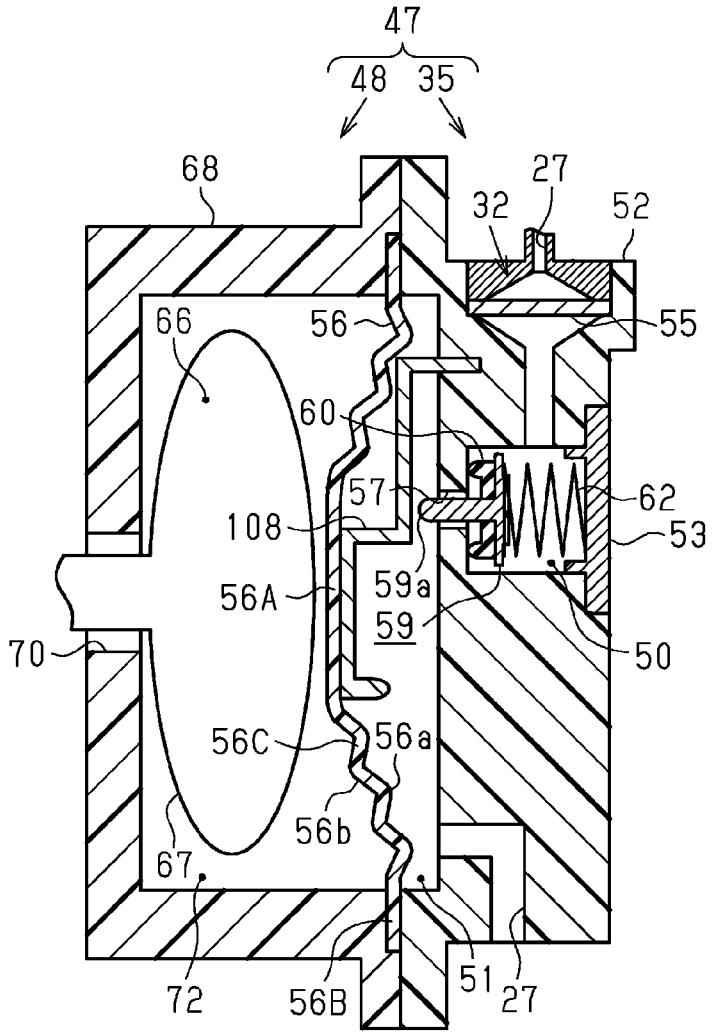
FIG. 22 is a schematic view in a fourth modification example of the pressure-regulating device.

As illustrated in FIG. 22, a plate spring 108 which is cantilevered may be provided inside the liquid accommodation unit 51 (fourth modification example). In addition, the plate spring 108 may cause the on-off valve 59 to be opened, by being deformed when a tip end thereof is pressed by the diaphragm section 56. The plate spring 108 presses the on-off valve 59 at a portion on a base end portion side, rather than a portion which is pressed by the diaphragm section 56.

According to the fourth modification example, the plate spring 108 becomes a lever. That is, the base end portion of the plate spring 108 becomes a fulcrum, a tip end portion of the plate spring 108 which is pressed by the diaphragm section 56 becomes a power point, and a working point which presses the on-off valve 59 is located between the fulcrum and the power point. For this reason, the plate spring 108 can press the on-off valve 59 by changing a pressing force of the diaphragm section 56 to a large force.

As illustrated in FIG. 22, the pressure-regulating device 47 may be provided with a filter unit 32. In addition, the liquid ejecting apparatus 11 may have a configuration in which the static mixer 33 or the liquid storage unit 34 is not provided.

In each of the above-described embodiments, the valve opening mechanism 48 may press the diaphragm section 56, by causing air to be ejected from an ejecting port which is formed in the pressure-regulating chamber 66. It is preferable that the ejecting port be formed at a position facing the pressure receiving portion 56A in the diaphragm section 56. That is, the pressure receiving portion 56A may be pressed in the diaphragm section 56, using a pressure of air which is ejected from the ejecting port associated with regulating of pressure in the inside of the pressure-regulating chamber 66 by the pressure regulator 69, in which the pressure is to be pressure higher than the atmospheric pressure.

In each of the above-described embodiments, the liquid ejecting apparatus 11 may be provided with a plurality of pressure regulators 69. For example, the pressure regulator 69 may be provided in each valve opening mechanism 48.

In each of the above-described embodiments, the moving unit 61 may be provided on the second face 56*b* side of the diaphragm section 56. That is, the valve opening mechanism 48 may press the diaphragm section 56 through the moving unit 61.

In each of the above-described embodiment, the liquid ejecting apparatus 11 may have a configuration in which the circulation path forming section 28 and the circulating pump 29 are not provided.

In each of the above-described embodiments, fluid supplied to the pressure-regulating chamber 66 or the fluid chamber 72 may be gas such as air, or may be liquid such as water or oil.

In each of the above-described embodiments, the pressure in the liquid accommodation unit 51 at which the on-off valve 59 is set to the open state from the closed state may be changed, by changing pressure in the fluid chamber 72. That is, it is possible to change conditions in which the on-off valve 59 is opened, by changing a magnitude of pressure applied to the second face 56*b*, since the diaphragm section 56 is displaced corresponding to a difference in pressure applied to the first face 56*a* and pressure applied to the second face 56*b*.

In each of the above-described embodiments, the actuator 24 may not be driven in the process of setting the on-off valve 59 from the open state to the closed state.

In each of the above-described embodiments, the on-off valve 59 may be set to the closed state from the open state, by releasing a pressing state of the diaphragm section 56, using the valve opening mechanism 48, after releasing pressurizing of liquid using the pressurizing mechanisms 31 and 88.

In the second embodiment, in the open state of the on-off valve 59, the pressurizing force which pressurizes the liquid by means of the pressurizing mechanism 88 may be constant. The pressurizing force which pressurizes the liquid by means of the pressurizing mechanism 88 may be changed in response to the state of the liquid ejecting unit 12 or the frequency at which the pressure cleaning is performed.

In each of the above-described embodiments, a plurality of pressurizing mechanisms 31 and 88 or different types of pressurizing mechanisms may be provided, and the pressurizing force which pressurizes the liquid may be changed by selecting the pressurizing mechanism which is driven. It is possible to arbitrarily select a gear pump, a screw pump, a piston pump, or the like, as the pressurizing mechanism.

In each of the above-described embodiments, a configuration in which the moving unit 61 is not provided may be adopted.

In each of the above-described embodiments, a projection portion 71*b* which is formed inside the annular recessed portion 71*a* may be formed in an annular shape along the opening 71. The projection portion 71*b* may be continuously formed in an annular shape, and may be intermittently formed in the annular shape. In addition, the projection portion 71*b* may be formed at a part of the annular recessed portion 71*a*.

In each of the above-described embodiments, the valve opening mechanism 48 may not press the diaphragm section 56 with a greater pressing force than the pressing force generated in a case in which the pressure which is obtained by adding the above-described predetermined value to the pressure with which the pressurizing mechanism 31 pressurizes the liquid in the pump chamber 41 (in case of pressurizing mechanism 88, pressure which pressurizes liquid in liquid pack 85) is added to the diaphragm section 56, when the diaphragm section 56 is pressed so that the pressure in the liquid accommodation unit 51 becomes higher than the pressure with which the meniscus 64 is broken.

In a case in which liquid is discharged from the nozzle 19 in the pressurizing cleaning, a pressure loss occurs due to a flow of the liquid since the liquid also flows in the liquid supply path 27, the liquid inflow unit 50, and the communication path 57 which are on the downstream side (in case of pressurizing mechanism 88, downstream side of liquid pack 85) of the pump chamber 41 of the pressurizing mechanism 31. Therefore, in a case in which the liquid is discharged from the nozzle 19, the pressure in the liquid accommodation unit 51 becomes a pressure in which the above-described pressure loss is subtracted from the pressure with which the pressurizing mechanism 31 pressurizes the liquid in the pump chamber 41 (in case of pressurizing mechanism 88, pressure which pressurizes liquid in liquid pack 85). For example, the valve opening mechanism 48 may press the diaphragm section 56 with a pressing force greater than the pressing force generated in a case in which the pressure obtained by adding the above-described predetermined value to a pressure obtained by subtracting the above-described pressure loss from the pressure with which the pressurizing mechanism 31 pressurizes the liquid in the pump chamber 41 (in case of pressurizing mechanism 88, pressure which pressurizes liquid in liquid pack 85) is applied to the diaphragm section 56 by taking the pressure loss into consideration.

In each of the above-described embodiments, the valve opening mechanism 48 may press the diaphragm section 56 so that the pressure in the liquid accommodation unit 51 becomes lower than the pressure with which the meniscus 64 is broken.

In each of the above-described embodiments, a configuration may be adopted in which the pressure regulator 69 is not provided. For example, the valve opening mechanism 48 may mechanically open the on-off valve 59 using a cam mechanism, or the like, for example.

The above-described first and second embodiments may have a configuration in which the expansion and contraction unit 67 is not provided. The second to fourth embodiments may have a configuration in which the expansion and contraction unit 67 is provided.

The above-described first to fourth embodiments may have a configuration in which the pressure regulator 69 is not provided. In addition, the fluid chamber 72 may include the fluid resistance unit 72*a*.

In the above-described embodiments, the fluid resistance unit 72*a* may be formed by causing the fluid chamber 72 and atmosphere to communicate, by opening a hole in the pressing member 68. The fluid resistance unit 72*a* may be set to a tortuous road which meanders. In addition, the fluid resistance unit 72*a* may be set to a valve which is opened in a case in which pressure in the fluid chamber 72 is high, and is closed in a case in which the pressure is low.

In each of the above-described embodiments, the liquid ejecting apparatus 11 may have a configuration in which the valve opening mechanism 48 is not provided. For example, the liquid ejecting apparatus 11 may be provided with a suctioning mechanism which suctions the inside the cap 134, and may open the on-off valve 59 by causing the suctioning mechanism to suction the inside of the cap 134 in a state in which the cap 134 covers the nozzle 19. That is, when the inside of the cap 134 becomes a negative pressure in a state in which the liquid ejecting unit 12 is capped, liquid is discharged from the nozzle 19. Then, the diaphragm section 56 is displaced in a direction in which a volume of the liquid accommodation unit 51 decreases, and the on-off valve 59 is opened, since the pressure in the liquid accommodation unit 51 decreases.

In each of the above-described embodiments, the liquid ejecting apparatus 11 may have a configuration in which the fluid chamber 72 is not provided.

In each of the above-described embodiments, the diaphragm section 56 may be configured of two layers among the inner layer 101, the outer layer 102, and the gas barrier layer 103. The inner layer 101 and the outer layer 102 may be configured by using different materials as main components. In addition, the diaphragm section 56 may be four layers or more. The number of layers of the diaphragm section 56 may be different in the pressure receiving portion 56A, the outer edge portion 56B, and the annular corrugated unit 56C. For example, the annular corrugated unit 56C may be a single layer, and the pressure receiving portion 56A and the outer edge portion 56B may be a plurality of layers. In addition, for example, the annular corrugated unit 56C may be a plurality of layers, and the pressure receiving portion 56A and the outer edge portion 56B may be a single layer.

In each of the above-described embodiments, the gas barrier layer may be formed by depositing metal such as aluminum, alumina (aluminum oxide), or the like, or a metal oxide with respect to at least one layer of the inner layer 101 and the outer layer 102.

In each of the above-described embodiments, in a case in which the diaphragm section 56 is a single layer, injection molding may be used. In the annular corrugated unit 56C, at least one projection portion, and at least one recessed portion may be formed, in a case of being viewed from the first face 56*a* side and the second face 56*b* side, respectively.

In each of the above-described embodiments, an annular recessed portion and an annular projection portion may be formed also in the pressure receiving portion 56A, similarly to the annular corrugated unit 56C.

In the above-described embodiments, the liquid ejecting apparatus may be a liquid ejecting apparatus which ejects or discharges liquid other than ink. The state of the liquid discharge from the liquid ejecting apparatus as minute droplets includes droplets which are particle-like, tear drop-like, or are drawn to have thread-like tails. Here, the liquid may be any material that can be ejected from the liquid ejecting apparatus. For example, as long as the material has a state in which the substance is a liquid phase, fluid-like substances such as a high or low viscosity liquid-like substance, sols, gel water, other inorganic solvents, organic solvents, solutions, liquid-like resins, and liquid-like metals (metal melts) are included. Not only a liquid as one state of the substance, but also particles of a functional material formed of a solvent such as a pigment or metal particles dissolved, dispersed, or mixed in a solvent and the like are included. Representative examples of the liquid include inks as described in the above embodiments and liquid crystals. Here, the wording "ink" generally encompasses aqueous inks and oil-based inks, as well as various liquid compositions such as gel inks and hot melt inks. Liquid ejecting apparatuses such which eject a liquid which includes an electrode material or a material such as a coloring material used in the manufacturing of an electroluminescence (EL) displays, face emission displays, and color filters in the form of a dispersion or solution are specific examples of the liquid ejecting apparatus. A liquid ejecting apparatus which ejects a bio-organic material used in biochip manufacturing, a liquid ejecting apparatus which is used as a precision pipette and ejects a liquid which becomes a sample, a textile printing device, a microdispenser and the like are also included. A liquid ejecting apparatus which ejects a pinpoint of a lubricating oil to a precision device, such a watch or a camera and a liquid ejecting apparatus which ejects a transparent resin material such as an ultraviolet curable resin onto a substrate in order to form a minute semi-spherical lens (optical lens) or the like used in an optical communication or the like may also be included. A liquid ejecting apparatus which ejects an etching liquid such as an acid or an alkali for etching a substrate or the like may also be included.

The entire disclosure of Japanese Patent Application No. 2015-234476, filed Dec. 1, 2015 is expressly incorporated by reference herein.

What is claimed is:

1. A liquid ejecting apparatus comprising:

a pressure-regulating mechanism which is provided in a liquid supply path capable of supplying liquid from a liquid supply source to a liquid ejecting unit ejecting the liquid from a nozzle, the pressure-regulating mechanism including a liquid accommodation part which is capable of accommodating the liquid internally, a volume of the liquid accommodation part being changed depending on displacing a diaphragm section; and a pressurizing mechanism which is capable of pressurizing the liquid which is supplied to the pressure-regulating mechanism, wherein the diaphragm section includes an annular corrugated portion formed in a sectional waveform shape which is deformed when the diaphragm section receives pressure, the waveform shape including a recessed portion and a projection portion that are alternatively formed, wherein the pressure-regulating mechanism includes a liquid inflow part into which the liquid supplied from the liquid supply source flows, the liquid accommodation part, a communication path through which the liquid inflow part and the liquid accommodation part communicate, and an on-off valve which enters an open state in which the liquid inflow part and the liquid accommodation part communicate, from a closed state in which the liquid inflow part and the liquid accommodation part do not communicate on the communication path, when pressure applied to a first face which is an inner face of the liquid accommodation part of the diaphragm section is lower than pressure applied to a second face which is an outer face of the liquid accommodation part of the diaphragm section, and a difference between the pressure applied to the first face and the pressure applied to the second face is a predetermined value or more, wherein the diaphragm section includes a pressure receiving portion which receives pressure at an on-off time of the on-off valve, and wherein the annular corrugated portion is provided between the pressure receiving portion and an outer edge portion of the diaphragm section.

2. The liquid ejecting apparatus according to claim 1, wherein at least the annular corrugated portion in the diaphragm section is configured of a single layer in which a material selected from a group including polyethylene, polypropylene, polyester, polyphenylene sulfide, polyimide, and polyamide is used as a main component.

3. The liquid ejecting apparatus according to claim 1, wherein at least the annular corrugated portion in the diaphragm section includes an inner layer in which a material selected from a group including polyethylene, polypropylene, polyester, polyphenylene sulfide, polyimide, and polyamide is used as a main component, and a gas barrier layer with high gas barrier properties compared to the inner layer, and wherein the gas barrier layer is provided on the second face side, rather than the inner layer.

4. The liquid ejecting apparatus according to claim 1, further comprising:

a fluid chamber which is formed so as to cover the second face of the diaphragm section, wherein the fluid chamber includes a fluid resistance unit which disturbs flowing out of fluid from the fluid chamber.

5. The liquid ejecting apparatus according to claim 1, further comprising:

a valve opening mechanism which sets the on-off valve to an open state; and a contact portion which is provided inside the liquid accommodation part, and is provided so as to be in contact with the annular corrugated portion, in an open state of the on-off valve using the valve opening mechanism.

6. The liquid ejecting apparatus according to claim 1, further comprising:

a valve opening mechanism which sets the on-off valve to an open state, wherein the liquid which is pressurized by the pressurizing mechanism is supplied to the liquid ejecting unit, in an open state of the on-off valve using the valve opening mechanism.

7. The liquid ejecting apparatus according to claim 6, wherein the valve opening mechanism includes an expansion and contraction unit which is capable of performing expansion and contraction, and is capable of pressing the diaphragm section in an expanded state, in the fluid chamber which is formed so as to cover the second face of the diaphragm section, presses the diaphragm section in a direction in which a volume of the liquid accommodation part decreases by expanding the expansion and contraction unit, and sets the on-off valve to an open state.

8. The liquid ejecting apparatus according to claim 6, wherein the valve opening mechanism presses the pressure receiving portion in the diaphragm section.

9. The liquid ejecting apparatus according to claim 6, wherein the valve opening mechanism includes a pressure regulator which is capable of regulating pressure in the fluid chamber which is formed on the second face side of the diaphragm section, presses the diaphragm section in a direction in which a volume of the liquid accommodation part decreases, by regulating pressure in the fluid chamber so as to be pressure higher than atmospheric pressure, and sets the on-off valve to an open state.

10. A pressure-regulating device comprising:

a pressure-regulating mechanism which is provided in a liquid supply path capable of supplying liquid from a liquid supply source to a liquid ejecting unit ejecting the liquid from a nozzle, the pressure-regulating mechanism including a liquid accommodation part which is capable of accommodating the liquid internally, a volume of the liquid accommodation part being changed depending on displacing of a diaphragm section, wherein the diaphragm section includes an annular corrugated portion formed in a sectional waveform shape which is deformed when the diaphragm section receives pressure, the waveform shape including a recessed portion and a projection portion that are alternatively formed, wherein the pressure-regulating mechanism includes a liquid inflow part into which the liquid supplied from the liquid supply source flows, the liquid accommodation part, a communication path through which the liquid inflow part and the liquid accommodation part communicate, and an on-off valve which enters an open state in which the liquid inflow part and the liquid accommodation part communicate, from a closed state in which the liquid inflow part and the liquid accommodation part do not communicate in the communication path, when a pressure applied to a first face which is an inner face of the liquid accommodation part of the diaphragm section is lower than the pressure applied to a second face which is an outer face of the liquid accommodation part of the diaphragm section, and a difference between the pressure applied to the first face and the pressure applied to the second face is a predetermined value or more, wherein the diaphragm section includes a pressure receiving portion which receives pressure at an on-off time of the on-off valve, and wherein the annular corrugated portion is provided between the pressure receiving portion and an outer edge portion of the diaphragm section.

* * * * *